US011795671B2

(12) United States Patent
Ukigai et al.

(10) Patent No.: US 11,795,671 B2
(45) Date of Patent: Oct. 24, 2023

(54) FAUCET FITTING

(71) Applicant: TOTO LTD., Fukuoka (JP)

(72) Inventors: Saori Ukigai, Fukuoka (JP); Ryojiro Hijikata, Fukuoka (JP); Ryo Koga, Fukuoka (JP)

(73) Assignee: TOTO LTD., Fukuoka (JP)

( * ) Notice: Subject to any disclaimer, the term of this patent is extended or adjusted under 35 U.S.C. 154(b) by 441 days.

(21) Appl. No.: 17/212,660

(22) Filed: Mar. 25, 2021

(65) Prior Publication Data

US 2021/0207349 A1 Jul. 8, 2021

Related U.S. Application Data

(63) Continuation of application No. PCT/JP2019/038371, filed on Sep. 27, 2019.

(30) Foreign Application Priority Data

Sep. 27, 2018 (JP) ..... 2018-181763
Mar. 29, 2019 (JP) ..... 2019-066032

(51) Int. Cl.
*E01C 1/00* (2006.01)
*C23C 22/03* (2006.01)
(Continued)

(52) U.S. Cl.
CPC ..... *E03C 1/10* (2013.01); *E03C 1/0404* (2013.01); *C23C 22/03* (2013.01)

(58) Field of Classification Search
CPC ..... E01C 1/00; B05B 1/18; B05B 1/22
See application file for complete search history.

(56) References Cited

U.S. PATENT DOCUMENTS

2002/0011280 A1 1/2002 Nitowski et al.
2011/0272284 A1 11/2011 Elbick et al.
2018/0244978 A1 8/2018 Drees et al.

FOREIGN PATENT DOCUMENTS

CN 1473209 A 2/2004
CN 102282296 A 12/2011
(Continued)

OTHER PUBLICATIONS

Extended European Search Report for related Application No. 19865107.7, dated Dec. 22, 2021.
(Continued)

*Primary Examiner* — Adam Krupicka
(74) *Attorney, Agent, or Firm* — MARSHALL, GERSTEIN & BORUN LLP

(57) ABSTRACT

Provided is a faucet fixture to which antifouling functionality is imparted without causing localized corrosion. The present invention is a faucet fixture comprising a metal base material and a plating layer partially formed on the surface of the metal base material. The metal base material contains at least one metal element species selected from the group consisting of copper, zinc, and tin. The plating layer contains at least one metal element species selected from the group consisting of chromium and nickel. An organic layer is further provided on the plating layer, with a passive layer present on the surface of the plating layer being interposed therebetween. The organic layer is bonded to the passive layer via the bonding of a metal element (M), which constitutes the passive layer, and a phosphorus atom (P) in at least one type of group (X) selected from the group consisting of phosphonate groups, phosphate groups, and phosphinate groups, with an oxygen atom (O) interposed therebetween (M-O—P bond). Group X is bonded to a group R (wherein R is a hydrocarbon group, or a group comprising an atom other than carbon at one or two locations within a
(Continued)

hydrocarbon group). The phosphorus atom concentration in the portion of the surface of the metal base material on which the plating layer is not formed is lower than the phosphorus atom concentration in the organic layer provided on the plating layer.

14 Claims, 9 Drawing Sheets

(51) Int. Cl.

| | |
|---|---|
| ***C23C 28/00*** | (2006.01) |
| ***E03C 1/10*** | (2006.01) |
| ***E03C 1/04*** | (2006.01) |

(56) References Cited

FOREIGN PATENT DOCUMENTS

| | | | |
|---|---|---|---|
| JP | 2000-265526 | A | 9/2000 |
| JP | 2002-518594 | A | 6/2002 |
| JP | 2004-217950 | A | 8/2004 |
| JP | 2013-185216 | A | 9/2013 |
| WO | WO-200236856 | A1 | 5/2002 |

OTHER PUBLICATIONS

Office Action and English translation from Chinese Application No. 201980003245.0 dated Apr. 6, 2022.
International Search Report from International Application No. PCT/JP2019/038371 dated Nov. 26, 2019.

FAUCET FITTING

CROSS-REFERENCE TO RELATED APPLICATIONS

This is a Continuation of International Application No. PCT/JP2019/038371, filed Sep. 27, 2019, which claims priority to Japanese Application No. 2018-181763, filed Sep. 27, 2018 and Japanese Application No. 2019-066032, filed Mar. 29, 2019, the contents of which are incorporated herein by reference.

TECHNICAL FIELD

The present invention relates to a faucet fitting containing a metal base material.

BACKGROUND ART

A faucet fitting is used in an environment where water is present. Therefore, water tends to adhere to the surface of the faucet fitting. It is known that when the water adhering to the surface dries, scales containing silica and calcium, which are components contained in tap water, are formed on the surface of the faucet fitting. It is also known that stains such as proteins, sebum, molds, microorganisms, and soap adhere to the surface of the faucet fitting.

Since it is difficult to prevent these stains from adhering to the surface of the faucet fitting, it is customary to remove the stains on the surface by cleaning to restore the original state. Specifically, these stains are removed by rubbing the surface of the faucet fitting with a cloth or sponge using detergent or tap water. Therefore, faucet fittings are required to have easiness to remove stains, that is, removal performance.

In addition, the faucet fitting is also required to have a high degree of design. In particular, a metal material is preferably used on the surface of the faucet fitting for its beautiful appearance. Therefore, it is required to impart removal performance without damaging the design of the metal material.

In this regard, a technique for removing scales using a water-repellent antifouling layer is known. Japanese Patent Application Publication No. 2000-265526 states that the fixation of silicic acid scale stains is suppressed by providing an antifouling layer that shields hydroxyl groups on the surface of pottery. It is disclosed that this antifouling layer is an antifouling layer coated and dried with a mixture of the hydroxyl groups on the surface of pottery, an organic silicon compound containing an alkyl fluoride group, a methylpolysiloxane compound containing a hydrolyzable group, and an organopolysiloxane compound.

In addition, Japanese Patent Application Publication No. 2004-217950 states that scale removal performance is obtained by treating the plated surface of a faucet or the like with a surface treatment agent for a plating film containing a fluorine atom-containing compound containing a fluorine-containing group and a group having a complex-forming ability.

CITATION LIST

Patent Literatures

Patent Literature 1: Japanese Patent Application Publication No. 2000-265526

Patent Literature 2: Japanese Patent Application Publication No. 2004-217950

SUMMARY OF INVENTION

Problems to be Solved by the Invention

The outer exterior of a faucet fitting is coated with a metal that can form a passivation film, such as chrome plating, but the inner side thereof has an exposed corrosive metal such as brass or zinc in the structure. When a layer of organic compound is formed on these, since the corrosion resistance is guaranteed by the passivation layer on the outer side, the corrosion resistance does not change due to the layer of organic compound, and only antifouling property can be imparted. On the other hand, when a layer of organic compound is formed on the inner side, it is considered that the corrosion resistance is improved by the barrier function of the layer of organic compound.

However, it has been found that when a layer of organic compound is formed on a metal base material on which a passivation layer is not formed, it causes "local corrosion" in which corrosion of a defective portion of the layer of organic compound is promoted. Local corrosion may cause problems such as a decrease in the strength of the structure and water leakage due to gaps in threaded portions, resulting in loss of the basic functions of the faucet fitting.

An object of the present invention is to provide a faucet fitting that imparts an antifouling function without causing local corrosion.

Means for Solution of the Problems

The present inventors have found that only an antifouling function can be imparted without causing local corrosion in the case of coating a faucet fitting with a layer of organic compound if the layer of organic compound is formed on the passivation layer, but the layer of organic compound is not formed on the metal surface on which the passivation layer is not formed. The present inventors have completed the present invention based on these findings. Specifically, the present invention provides a faucet fitting, the faucet fitting including:

- a metal base material; and
- a plating layer partially formed on a surface of the metal base material, wherein
- the metal base material contains at least one metal element selected from the group consisting of copper, zinc, and tin,
- the plating layer contains at least one metal element selected from the group consisting of chromium and nickel,
- a layer of organic compound is further provided on the plating layer via a passivation layer existing on the surface of the plating layer,
- the layer of organic compound binds to the passivation layer by binding the metal element (M) constituting the passivation layer via an oxygen atom (O) to a phosphorus atom (P) of at least one group (X) selected from a phosphonic acid group, a phosphoric acid group, and a phosphinic acid group (M-O—P bond), and the group X is bonded to a group R, where R is a hydrocarbon group or a group having an atom other than carbon at one or two positions in the hydrocarbon group, and
- a phosphorus atom concentration on a surface of a portion where the plating layer is not formed on the metal base material is lower than a phosphorus atom concentration on a surface of the layer of organic compound provided on the plating layer.

Advantageous Effects of Invention

According to the present invention, the faucet fitting can be provided with an antifouling function without causing local corrosion.

DESCRIPTION OF EMBODIMENTS

Figure 1A:
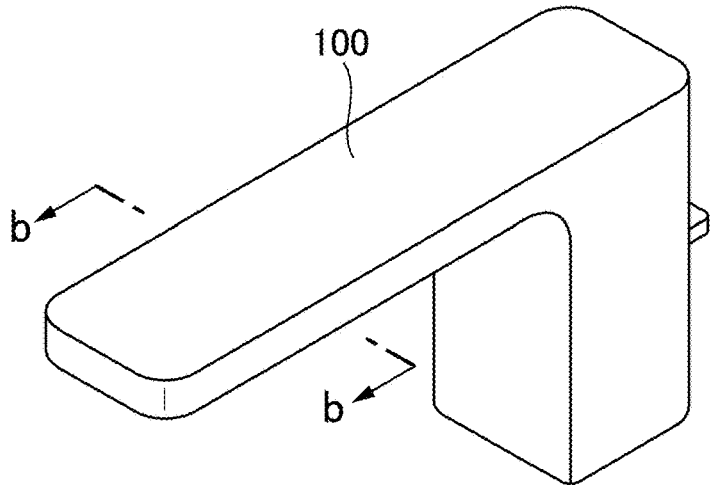
FIG. 1A is a diagram illustrating an appearance example of a preferable embodiment of a faucet fitting of the present invention.
Figure 1B:
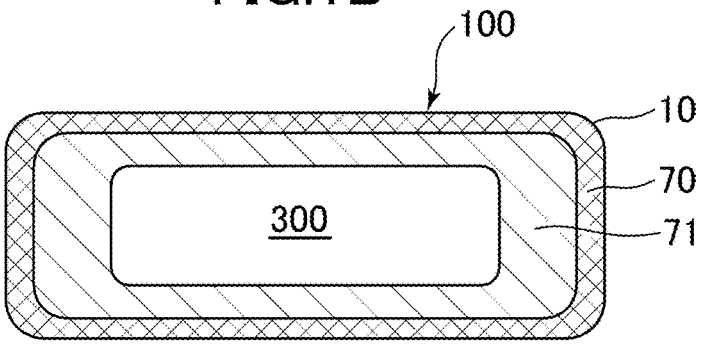
FIG. 1B is a cross-sectional diagram taken along line b-b in FIG. 1A.
Figure 2:
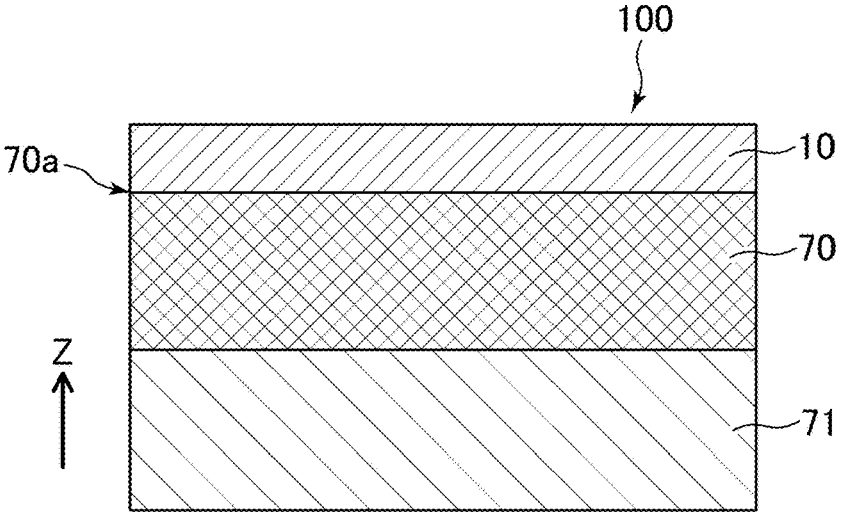
FIG. 2 is a schematic diagram illustrating an embodiment of the configuration of the faucet fitting of the present invention.

FIG. 1A is a diagram illustrating an appearance example of a faucet fitting of the present invention, and FIG. 1B is a cross-sectional diagram taken along line b-b in FIG. 1A. In the present invention, a faucet fitting 100 is an instrument connected to a water supply pipe for supplying water, and includes an inner water passage 300 for passing water therethrough and an outer surface normally visible to the user. The faucet fitting 100 includes a spout including a water outlet, an operation handle, a mounting leg, a water supply pipe, a pedestal, and the like. The faucet fitting 100 is provided with a plating layer 70 on the outer surface thereof, and the plating layer is not positively formed on the inner surface (including the water passage) which is not normally visible to the user. Therefore, the surface of the inner surface has a portion where the metal base material 71 is exposed. As illustrated in FIG. 2, the faucet fitting 100 in the present invention is provided with a metal base material 71 and a plating layer 70 formed on the surface of the metal base material, and includes a layer 10 of organic compound provided on the plating layer via a passivation layer 70*a*. The direction from the metal base material 71 toward the layer 10 of organic compound is defined as the Z direction. The metal base material 71, the plating layer 70, and the layer 10 of organic compound are arranged in this order in the Z direction. Note that in the present invention, "on" in "layer of organic compound provided on the plating layer" means a state where the layer of organic compound is not in direct contact with the plating layer. The "state where the layer of organic compound is not in direct contact with the plating layer" is a state where the passivation layer is present on the surface of the plating layer, and the layer of organic compound is arranged on the surface of the passivation layer.

Figure 3:
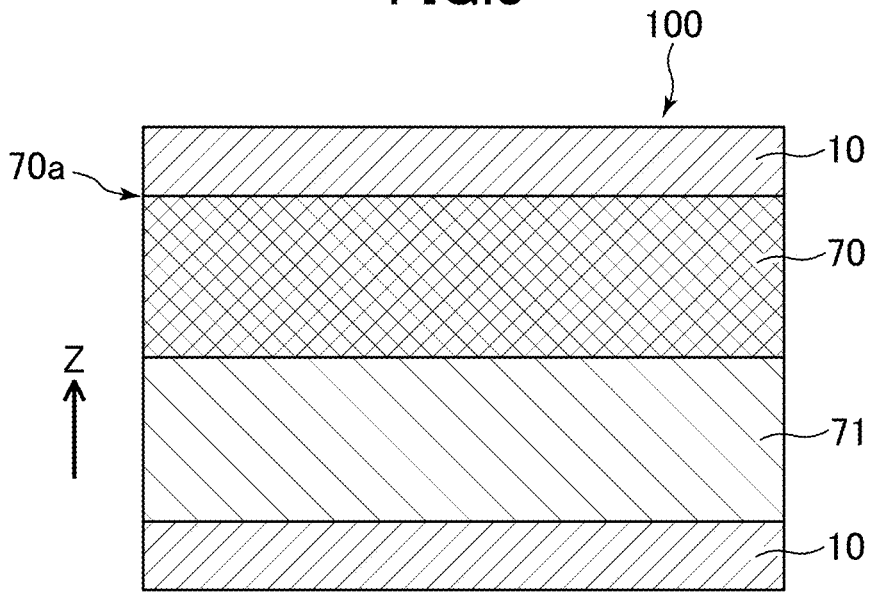
FIG. 3 is a schematic diagram illustrating the configuration of a conventional faucet fitting.

Since the faucet fitting has a complicated three-dimensional shape, spraying or immersion is preferably used for industrially forming a layer of organic compound. When the layer of organic compound is formed by such a production method, the layer of organic compound is also formed in the portion without the plating layer 70, as illustrated in FIG. 3. There are many portions without a plating layer on the inner side of the faucet fitting, and they are often portions that come into contact with water for a long time, such as a passage of water. In the case of industrially forming the layer of organic compound, it is difficult to completely remove pollutants such as dust adhering to the base material before the formation. Therefore, the layer of organic compound has a defective portion of several μm to several hundred μm. Even when there is such a defective portion, the antifouling function of the layer of organic compound is not impaired. However, the inventors have found that when the layer of organic compound is formed in a portion without the plating layer, the corrosion of the metal base material is promoted in the defective portion.

Figure 4:
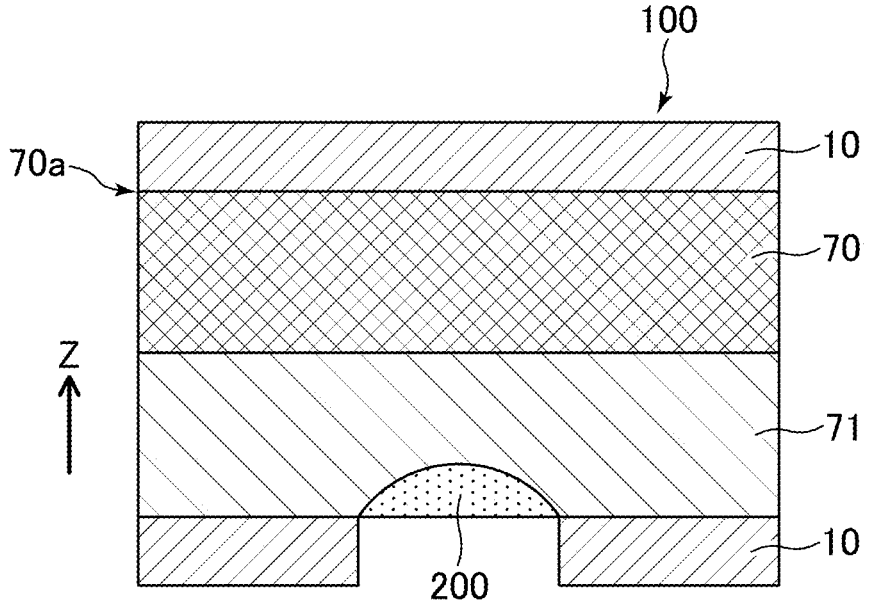
FIG. 4 is a schematic diagram of a conventional faucet fitting when local corrosion occurs.

Consider the case where the layer 10 of organic compound is formed on the surface of the metal base material 71 on which a passivation layer is not formed. When the layer of organic compound comes into contact with water, metal ions elute at the defective portion of the layer of organic compound, and an electrochemical reaction is started. As the reaction progresses, the concentration of electrolytes locally increases at the defective portion of the layer of organic compound. It is conceivable that, as a result, the reaction is further promoted, and the corrosion proceeds in a short time, accelerating the occurrence of "local corrosion" 200 in which the corrosion of the defective portion of the layer of organic compound is promoted, as illustrated in FIG. 4.

On the other hand, when the layer of organic compound is not formed on the surface of the metal base material 71 on which a passivation layer is not formed, it is conceivable that the electrochemical reaction proceeds slowly and no visible corrosion occurs because the local electrolyte concentration does not increase.

Further, regarding the layer of organic compound formed on the plating layer, a passivation layer is formed on the surface of the plating layer, and thus elution of metal ions in the defective portion is unlikely to occur. Therefore, it is presumed that the "local corrosion" 200 does not occur because the electrochemical reaction in the defective portion of the layer of organic compound is suppressed.

Specifically, when the layer of organic compound formed on the surface of the metal base material is made significantly smaller in phosphorus atom concentration than the layer of organic compound formed on the surface of the plating layer, the faucet fitting of the present invention can be provided with an antifouling function without causing local corrosion.

The metal base material 71 is made up of a metal having a property of not forming a passivation film on the surface thereof. Specifically, the metal base material contains at least one metal element selected from the group consisting of copper, zinc, and tin. The metal base material may be a metal made up of these metal elements, or may be an alloy containing these metal elements. As the metal base material of the faucet fitting, copper alloys such as brass and bronze, and zinc alloys are preferably used. In the present invention, the method of producing the metal base material is not particularly limited, but it is preferably produced by casting or forging, and adjusting the shape by cutting, polishing, or the like.

The plating layer 70 may be a single layer or a plurality of layers, but the layer on the surface side is made up of a metal having a property of forming a passivation film. Preferable metals are chromium and nickel, and chromium is more preferable. A normal faucet fitting has a two-layer structure in which a chrome plating layer is formed on the surface side and a nickel alloy plating layer is formed on the base material side. The method of forming the plating layer is not particularly limited, but it is preferably formed by a wet plating method.

The passivation layer 70*a* contains oxygen atoms and metal atoms, and preferably contains oxygen atoms and metal atoms of the same type as the metal element constituting the plating layer.

In the present invention, the layer 10 of organic compound is a layer formed by using R—X described later, and is preferably a monolayer, and more preferably a self-assembled monolayer (SAM). Since the self-assembled monolayer is a layer in which molecules are densely assembled, most of the hydroxyl groups existing on the surface on which the layer is formed can be shielded. A molecule that can be self-assembled has a structure of a surfactant, and has a functional group (head group) having a high affinity with the passivation layer and a moiety having a low affinity with the passivation layer. Surfactant molecules having a phosphonic acid group, a phosphoric acid group, and a phosphinic acid group as head groups have an ability to form SAM on metal oxide. The thickness of the SAM is about the same as the length of one constituent molecule. Here, the "thickness" refers to the length of the SAM in the Z direction, and does not necessarily mean the length of the R—X itself. The thickness of the SAM is 10 nm or less, preferably nm or less, and more preferably 3 nm or less. In addition, the thickness of the SAM is 0.5 nm or more, and preferably 1 nm or more. In the case of using constituent molecules such that the thickness of SAM falls within such a range, it is possible to efficiently coat the plating layer, and to obtain a faucet fitting having excellent scale removal performance.

In the present invention, SAM is an aggregate of molecules formed on the surface of a base material in the process of organic molecules adsorbing to the surface of a solid, and the interaction between the molecules causes the molecules constituting the aggregate to densely aggregate. In the present invention, the SAM contains hydrocarbon groups. As a result, hydrophobic interaction acts between the molecules and allows the molecules to densely assemble, so that it is possible to obtain a faucet fitting having excellent scale removal performance.

In the present invention, SAM is a layer formed by using a compound represented by the general formula R—X (R is a hydrocarbon group or a group having an atom other than carbon at one or two positions in the hydrocarbon group, and X is at least one selected from a phosphonic acid group, a phosphoric acid group, and a phosphinic acid group).

In the present invention, the layer 10 of organic compound is a layer formed by using R—X. R is a hydrocarbon group made up of C and H. In addition, R may have an atom other than carbon at one or two positions in the hydrocarbon group. Preferably, one end of R, which is an end that is not a bonding end with X, is made up of C and H, for example a methyl group. As a result, the surface of the faucet fitting becomes water-repellent, making it possible to improve the scale removal performance.

More preferably, R is a hydrocarbon group made up of C and H. The hydrocarbon group may be a saturated hydrocarbon group or an unsaturated hydrocarbon group. In addition, it may be an open chain hydrocarbon, or may contain a cyclic hydrocarbon such as an aromatic ring. R is preferably an open chain saturated hydrocarbon group, and more preferably a straight-chain saturated hydrocarbon group. Since the open chain saturated hydrocarbon group is a flexible molecular chain, it is possible to cover the surface on which the layer of organic compound is formed without gaps and improve water resistance. When R is an open chain hydrocarbon group, it is preferably an alkyl group having 6 or more and 25 or less carbon atoms. R is more preferably an alkyl group having 10 or more and 18 or less carbon atoms. When the number of carbon atoms is large, the interaction between the molecules is large, so that it is possible to shorten the distance between alkyl chains, making it possible to further improve the water resistance. On the other hand, too large a number of carbon atoms results in slow formation rate of monolayer and deterioration of the production efficiency.

It is preferable that R is free of a halogen atom, particularly a fluorine atom. It is preferable that R is free of a highly polar functional group (sulfonic acid group, hydroxyl group, carboxylic acid group, amino group, or ammonium group) or heterocyclic skeleton on one end side. A layer formed by using a compound free of halogen atom or these functional groups is high in scale removal performance and its durability.

X is at least one selected from a phosphonic acid group, a phosphoric acid group, and a phosphinic acid group among functional groups containing a phosphorus atom, and is preferably a phosphonic acid group. As a result, it is possible to efficiently obtain a faucet fitting having high water resistance and excellent scale removal performance.

The organic phosphonic acid compound represented by the general formula R—X is preferably octadecylphosphonic acid, hexadecylphosphonic acid, dodecylphosphonic acid, decylphosphonic acid, octylphosphonic acid, hexylphosphonic acid, and decyloxy methylphosphonic acid, and more preferably octadecylphosphonic acid, hexadecylphosphonic acid, dodecylphosphonic acid, and decylphosphonic acid. Further, octadecylphosphonic acid is more preferable.

In the present invention, the layer of organic compound may be formed of two or more types of R—X. The layer of organic compound formed of two or more types of R—X means a layer of organic compound formed by mixing multiple types of the above-mentioned compounds. In addition, in the present invention, the layer of organic compound may contain a trace amount of organic molecules other than R—X as long as the scale removal performance is not impaired.

The upper limit of the thickness of the layer of organic compound is preferably 50 nm or less, more preferably 20 nm or less, and further preferably 10 nm or less. The lower limit of the thickness of the layer of organic compound is preferably 0.5 nm or more, and more preferably 1 nm or more. A suitable range can be formed by appropriately combining these upper limit values and lower limit values. Here, the "thickness" refers to the length of the layer of organic compound in the Z direction.

As a method of measuring the thickness of the layer of organic compound, it is possible to use any one of X-ray photoelectron spectroscopy (XPS), X-ray reflectometry (XRR), ellipsometry, and surface enhanced Raman spectroscopy, and in the present invention, the thickness of the layer of organic compound is measured by XPS. Even when the layer of organic compound is formed of two or more types of R—X, the thickness measured by XPS is regarded as the average thickness of the layer of organic compound, and the thickness obtained by the measurement presented below is defined as the thickness of the layer of organic compound. In that case, the thickness of the layer of organic compound can be measured by so-called XPS depth profile measurement in which argon ion beam sputtering or argon gas cluster ion beam (Ar-GCIB) sputtering is used in combination with XPS measurement to sequentially perform surface composition analysis with the ion sputtered surfaces after removal of layer step by step (see FIGS. 5 and 7 and FIG. 8 described later). The depth distribution curve obtained by such XPS depth profile measurement can be created with the vertical axis representing each atomic concentration (unit: at %) and the horizontal axis representing the sputtering time. In the depth distribution curve with the horizontal axis as the sputtering time, the sputtering time generally correlates with the distance from the surface in the depth direction. As the distance from the surface of the faucet fitting (or the layer of organic compound) in the Z direction, the distance from the surface of the faucet fitting (or the layer of organic compound) can be calculated from the relationship between the sputtering rate and the sputtering time employed in the XPS depth profile measurement.

In the case of argon ion beam sputtering, the measurement point with a sputtering time of 0 minutes is set to the surface (0 nm), and the measurement is performed until the depth is 20 nm from the surface. The carbon atom concentration in the base material is defined as the carbon concentration at a depth of about 20 nm from the surface. The carbon atom concentration is measured in the depth direction from the surface, and the maximum depth at which the carbon atom concentration is higher by 1 at % or more than the carbon atom concentration of the base material is evaluated as the thickness of the layer of organic compound.

In addition, in the case of Ar-GCIB, the thickness of the layer of organic compound is evaluated as follows. First, the standard sample of film thickness prepared is a standard sample in which a layer of organic compound formed by using octadecyltrimethoxysilane is formed on a silicon wafer, and X-ray reflectometry (XRR) (X'pert pro manufactured by PANalytical Ltd.) is performed to obtain a (X-ray) reflectivity profile. For the obtained (X-ray) reflectivity profile, analysis software (X'pert Reflectivity) is used to perform fitting to the multilayer film model of Parratt and the roughness formula of Nevot-Crosse, to thereby obtain the film thickness of the standard sample. Next, Ar-GCIB measurement is performed on the standard sample to obtain the sputtering rate (nm/min) of SAM. For the film thickness of the layer of organic compound on the surface of the faucet fitting, the obtained sputtering rate is used to convert the sputtering time into the distance from the surface of the faucet fitting in the Z direction. The XRR measurement and analysis conditions and the Ar-GCIB measurement conditions are as follows.

(XRR Measurement Conditions)
- Device: X'pert pro (PANalytical Ltd.)
- X-ray source: CuKα
- Tube voltage: 45 kV
- Tube current: 40 mA
- Incident Beam Optics
- Divergence slit: ¼°
- Mask: 10 mm
- Solar slit: 0.04 rad
- Anti-scattering slit: 1°
- Diffracted Beam Optics
- Anti-scattering slit: 5.5 mm
- Solar slit: 0.04 rad
- X-ray detector: X'Celerator
- Pre Fix Module: Parallel plate Collimator 0.27
- Incident Beam Optics: Beam Attenuator Type Non
- Scan mode: Omega
- Incident angle: 0.105-2.935

(XRR Analysis Conditions)
- The following initial conditions are set.
- Layer sub: Diamond Si (2.4623 g/cm3)
- Layer 1: Density Only SiO2 (2.7633 g/cm3)
- Layer 2 Density Only C (1.6941 g/cm3)

(Ar-GCIB Measurement Conditions)
- Device: PHI Quantera II (manufactured by ULVAC-PHI, Inc.)
- X-ray conditions: monochromatic AlKα ray, 25 W, 15 kv
- Analysis area: 100 mφ
- Charge neutralizer setting: 20 μA
- Ion gun setting: 7.00 mA
- Photoelectron take-off angle: 45°
- Time per step: 50 ms
- Sweep: 10 times
- Pass energy: 112 eV
- Measurement interval: 10 min
- Spatter-setting: 2.5 kV
- Binding energy: depends on the measurement element For the measurement sample, the measurement point with a sputtering time of 0 minutes is set as the surface (0 nm), and the measurement is performed up to a sputtering time of 100 minutes. Note that in the measurement of the thickness of the layer of organic compound, argon ion beam sputtering is employed to obtain an approximate value in a semi-quantitative manner, and high depth-resolution (because of soft ion beam sputtering technic) Ar-GCIB is used to obtain a thickness in a quantitative manner.

In the present invention, when measuring the thickness of the layer of organic compound on the surface, the surface of the faucet fitting is washed before the measurement to sufficiently remove the stains adhering to the surface. For example, wipe washing with ethanol and sponge slide washing with a neutral detergent are followed by thorough rinse washing with ultrapure water. Further, in the case of a rough-surfaced faucet fitting whose surface has been subjected to hairline processing, shot blasting, or the like, a portion with as high surface smoothness as possible is selected and measured.

In the present invention, before confirming in detail that the layer of organic compound is a layer formed by using R—X by the method presented below, it may be simply confirmed by measuring C—C bonds and C—H bonds that the layer of organic compound is formed by using a compound having R. The C—C bond and the C—H bond can be confirmed by X-ray photoelectron spectroscopy (XPS), surface enhanced Raman spectroscopy, and infrared reflection absorption spectroscopy (IRRAS). When XPS is used, the spectrum in the range where the C1s peak appears (278 to 298 eV) is obtained, and the peak near 284.5 eV derived from the C—C bond and the C—H bond is confirmed. When measuring the C—C bond and the C—H bond, the surface of the faucet fitting is washed before the measurement to sufficiently remove the stains adhering to the surface.

In the present invention, before confirming in detail that the layer of organic compound is a layer formed by using R—X by the method presented below, it may be simply confirmed that the layer of organic compound is formed by using a compound having X by measuring a phosphorus atom (P) or a bond between a phosphorus atom (P) and an oxygen atom (O) (P—O bond). Phosphorus atoms can be confirmed by determining the phosphorus atom concentration by X-ray photoelectron spectroscopy (XPS). The P—O bond can be confirmed by, for example, surface enhanced Raman spectroscopy, infrared reflection absorption spectroscopy, and X-ray photoelectron spectroscopy (XPS). When XPS is used, the spectrum in the range where the P2p peak appears (122 to 142 eV) is obtained, and the peak near 133 eV derived from the P—O bond is confirmed.

In the present invention, it is confirmed in detail by the following procedure that the layer of organic compound is a layer formed by using R—X. First, surface elemental analysis is performed by XPS analysis, and it is confirmed that C, P, and O are detected. Next, the molecular structure is specified by mass spectrometry from the mass-to-charge ratio (m/z) derived from the molecules of the components existing on the surface. For mass spectrometry, time-of-flight secondary ion mass spectrometry (TOF-SIMS) or high resolution mass spectrometry (HR-MS) can be used. Here, the high resolution mass spectrometry (HR-MS) refers to a method in which the mass resolution can be measured with an accuracy of less than 0.0001 u (u: unified atomic mass units) or 0.0001 Da, and the elemental composition can be estimated from the precise mass. The HR-MS includes double-focusing mass spectrometry, time-of-flight tandem mass spectrometry (Q-TOF-MS), Fourier transform ion cyclotron resonance mass spectrometry (FT-ICR-MS), Orbitrap mass spectrometry, and the like, and the present invention uses time-of-flight tandem mass spectrometry (Q-TOF-MS). For mass spectrometry, it is desirable to use HR-MS when sampling of R—X in a sufficient amount from the part is possible. On the other hand, when sampling of R—X in a sufficient amount from the part is impossible due to the small size of the part or the like, it is desirable to use TOF-SIMS. When mass spectrometry is used, the presence of R—X can be confirmed by detecting the ionic intensity of m/z corresponding to the ionized R—X. Here, it is regarded that the ionic intensity is detected by having three times or more of the signal of the average value of 50 Da before and after, centering on m/z, which is the lowest value in the range in which the ionic intensity is calculated in the measurement range.

For the time-of-flight secondary ion mass spectrometry (TOF-SIMS) device, for example, TOF-SIMS 5 (manufactured by ION-TOF) is used. The measurement conditions are such that primary ions to be emitted: $^{209}Bi_3^{++}$, primary ion acceleration voltage 25 kV, pulse width 10.5 or 7.8 ns, bunching: on, electrification neutralization: off, post acceleration 9.5 kV, measurement range (area): about 500×500 $\mu m^2$, secondary ions to be detected: Positive, Negative, Cycle Time: 110 μs, scan count 16. As a measurement result, a secondary ion mass spectrum (m/z) derived from R—X is obtained. In the secondary ion mass spectrum, the horizontal axis represents the mass-to-charge ratio (m/z), and the vertical axis represents the intensity of the detected ions (count).

As the high resolution mass spectrometer, a time-of-flight tandem mass spectrometer (Q-TOF-MS), for example, Triple TOF 4600 (manufactured by SCIEX) is used. In the measurement, for example, the cutout base material is immersed in ethanol, and the component (R—X) used for forming the layer of organic compound is extracted with unnecessary components filtered, transferred to a vial (about 1 mL), and then measured. MS/MS measurement is performed under the measurement conditions that ion source: ESI/Duo Spray Ion Source, ion mode (Positive/Negative), IS voltage (−4500 V), source temperature (600° C.), DP (100 V), and CE (40 V), for example. As a measurement result, an MS/MS spectrum is obtained. In the MS/MS spectrum, the horizontal axis represents the mass-to-charge ratio (m/z), and the vertical axis represents the intensity of the detected ions (count).

Confirmation that one end of R is made up of C and H and that R is a hydrocarbon made up of C and H is confirmed by using surface enhanced Raman spectroscopy.

When surface enhanced Raman spectroscopy is used, it is performed by confirming a Raman shift ($cm^{-1}$) derived from the fact that one end of R is made up of C and H and that R is a hydrocarbon made up of C and H. The surface enhanced Raman spectroscopy analyzer includes a transmission-type plasmonic sensor (for surface enhanced Raman spectroscopy) and a confocal microscope Raman spectrometer. As the transmission-type plasmonic sensor (for surface enhanced Raman spectroscopy), for example, the one described in Japanese Patent No. 6179905 is used. As the confocal microscope Raman spectrometer, for example, NanoFinder 30 (Tokyo Instruments, Inc.) is used. The measurement is performed with a transmission-type surface enhanced Raman sensor placed on the surface of the cutout faucet fitting. The measurement conditions are such that Nd: YAG laser (532 nm, 1.2 mW), scan time (10 seconds), grating (800 Grooves/mm), and pinhole size (100 μm). A Raman spectrum is obtained as a measurement result. In the Raman spectrum, the horizontal axis is Raman shift ($cm^{-1}$) and the vertical axis is signal intensity. When one end of R is a methyl group, a Raman shift (around 2930 $cm^{-1}$) derived from the methyl group is confirmed. When the end of R is a different hydrocarbon, the corresponding Raman shift is confirmed. In addition, when the hydrocarbon whose R is made up of C and H is an alkyl group (—$(CH_2)_n$—), it is confirmed by detecting a Raman shift at around 2850 $cm^{-1}$ and around 2920 $cm^{-1}$. In the case of different hydrocarbon groups, the corresponding Raman shift is confirmed. It is regarded that the Raman shift signal is detected when it is three times or more the average value of the signal intensity of 100 $cm^{-1}$ in the range where the signal intensity is the lowest in the measurement range.

TOF-SIMS can be used to confirm that R is a hydrocarbon made up of C and H. When TOF-SIMS analysis is used, confirmation is made in such a way that in the secondary ion mass spectrum obtained under the same analytical conditions as the confirmation of R—X, the peak detected every m/z=14 is derived from the alkyl group (—$(CH_2)_n$—).

Confirmation that the layer of organic compound is a monolayer can be made based on the thickness of the layer of organic compound obtained by the above method and the molecular structure of the compound represented by the general formula R—X identified by the above method. First, the molecular length of the compound represented by the general formula R—X is estimated based on the identified molecular structure. Then, when the thickness of the obtained layer of organic compound is less than twice the molecular length of the estimated compound, it is regarded as a monolayer. Note that the thickness of the layer of organic compound is the average value of the thicknesses obtained by measuring three different points. Further, when the layer of organic compound is formed of two or more types of compounds represented by the general formula R—X, and if the thickness of the obtained layer of organic compound is less than twice the longest molecular length of the estimated compound, it is regarded as a monolayer.

Confirmation that the layer of organic compound is SAM can be made by confirming that the layer of organic compound forms a dense layer in addition to the above-mentioned confirmation that the layer of organic compound is a monolayer. Confirmation that the layer of organic compound forms a dense layer can be made by the phosphorus atom concentration on the surface described above. Specifically, when the phosphorus atom concentration is 1.0 at % or more, it can be said that the layer of organic compound forms a dense layer.

It is conceivable that in the layer of organic compound and the passivation layer or base material on which the layer of organic compound is formed, a metal atom (M) derived from the passivation layer or base material binds via an oxygen atom (O) to a phosphorus atom (P) derived from the compound R—X (M-O—P bond). For example, the M-O—P bond can be confirmed by time-of-flight secondary ion mass spectrometry (TOF-SIMS), surface enhanced Raman spectroscopy, infrared reflection absorption spectroscopy, infrared absorption spectroscopy, and X-ray photoelectron spectroscopy (XPS), and in the present invention, confirmation is made by using both time-of-flight secondary ion mass spectrometry (TOF-SIMS) and surface enhanced Raman spectroscopy in combination. When X is a phosphonic acid group, a maximum of three M-O—P bonds can be formed for one X. When one X is fixed to the metal oxide by multiple M-O—P bonds, the layer of organic compound improves in water resistance and wear resistance.

In the present invention, the M-O—P bond is confirmed by the following procedure. First, surface elemental analysis is performed by XPS analysis, and it is confirmed that C, P, and O are detected. Next, a time-of-flight secondary ion mass spectrometer (TOF-SIMS), for example, TOF-SIMS 5 (manufactured by ION-TOF) is used. The measurement conditions are such that primary ions to be emitted: $^{209}Bi_3^{++}$, primary ion acceleration voltage 25 kV, pulse width 10.5 or 7.8 ns, bunching: on, electrification neutralization: off, post acceleration 9.5 kV, measurement range (area): about 500×500 $\mu m^2$, secondary ions to be detected: Positive, Negative, Cycle Time: 110 μs, scan count 16. As a measurement result, a secondary ion mass spectrum (m/z) derived from R—X is obtained. Confirmation is made by obtaining, as results of the measurement, a secondary ion mass spectrum derived from a combination of R—X and the metal oxide element M (R—X-M) and a secondary ion mass spectrum derived from M-O—P (m/z). In the secondary ion mass spectra, the horizontal axis represents the mass-to-charge ratio (m/z), and the vertical axis represents the intensity of the detected ions (count).

Next, a Raman shift ($cm^{-1}$) derived from M-O—P bond is confirmed by surface enhanced Raman spectroscopy analysis. The surface enhanced Raman spectroscopy analyzer includes a transmission-type plasmonic sensor (for surface enhanced Raman spectroscopy) and a confocal microscope Raman spectrometer. As the transmission-type plasmonic sensor (for surface enhanced Raman spectroscopy), for example, the one described in Japanese Patent No. 6179905 is used. As the confocal microscope Raman spectrometer, for example, NanoFinder 30 (Tokyo Instruments, Inc.) is used. The measurement is performed with a transmission-type surface enhanced Raman sensor placed on the surface of the cutout faucet fitting. The measurement conditions are such that Nd: YAG laser (532 nm, 1.2 mW), scan time (10 seconds), grating (800 Grooves/mm), and pinhole size (100 μm). A Raman spectrum is obtained as a measurement result. In the Raman spectrum, the horizontal axis is Raman shift ($cm^{-1}$) and the vertical axis is signal intensity. The signal derived from the M-O—P bond can be assigned from the Raman spectrum estimated for the bond state of the M-O—P bond by using the first principle calculation software package: Material Studio. As the calculation conditions for the first principle calculation, structure optimization is performed with, for example, software used (CASTEP), functional (LDA/CA-PZ), cutoff (830 eV), K point (2*2*2), pseudopotential (Norm-conserving), Dedensity mixing (0.05), spin (ON), and Metal (OFF). In addition, Raman spectrum calculation is performed with, for example, software used (CASTEP), functional (LDA/CA-PZ), cutoff (830 eV), K point (1*1*1), pseudopotential (Norm-conserving), Dedensity mixing (All Bands/EDFT), spin (OFF), and Metal (OFF). For example, in the case of phosphonic acid group, the possible M-O—P bond states include a state where there is one M-O—P bond for one phosphonic acid group, a state where there are two M-O—P bonds for one phosphonic acid group, and a state where there are three M-O—P bonds for one phosphonic acid group. It is confirmed that the faucet fitting of the present invention contains at least one of the bond states. When the Raman spectrum obtained from surface enhanced Raman spectroscopy analysis is assigned by the Raman spectrum obtained by first principle calculation, it is confirmed that the characteristic Raman shifts match at two or more points for each M-O—P bond state. Here, the fact that the Raman shifts match means that the signal is detected by both the first principle calculation and the surface enhanced Raman spectroscopy analysis in the range of ±2.5 $cm^{-1}$ (5 $cm^{-1}$) of the Raman shift value considered to be derived from the M-O—P bond to be compared.

In the faucet fitting of the present invention, the phosphorus atom concentration on the surface of the portion where the layer of organic compound is provided on the plating layer is preferably more than 1.0 at % and 10 at % or less, more preferably 1.2 at % or more and 10 at % or less, and further preferably 1.5 at % or more and 10 at % or less. Particularly preferably, the phosphorus atom concentration is 2.0 at % or more. As a result, the sliding resistance of the faucet fitting is improved, and better stain removability can be imparted. In addition, in the faucet fitting of the present invention, the phosphorus atom concentration on the surface of the portion where the plating layer is not formed on the metal base material is lower than the phosphorus atom concentration on the surface of the portion where the layer of organic compound is provided on the plating layer. This suppresses local corrosion. The phosphorus atom concentration on the surface of the portion where the plating layer is not formed on the metal base material is preferably 1.0 at % or less, and more preferably 0.9 at % or less. More preferably, there are no phosphorus atoms on the surface of the portion where the plating layer is not formed on the metal base material. Here, "no" means being below the detection limit by the following method.

The phosphorus atom concentration on the surface of the faucet fitting of the present invention can be determined by X-ray photoelectron spectroscopy (XPS). Wide scan analysis (also referred to as survey analysis) is performed using condition 1 as the measurement condition.

(Condition 1)

X-ray condition: monochromatic AlKα ray (output 25 W)

Photoelectron take-off angle: 45°

Analysis area: 100 μmφ

Scanning range: 15.5 to 1100 eV

As the XPS device, PHI Quantera II (manufactured by ULVAC-PHI, Inc.) can be used. The spectrum is obtained by wide scan analysis under the conditions of X-ray condition (monochromatic AlKα ray, 25 W, 15 kv), analysis area: 100 μmφ, charge neutralizer setting (Emission: 20 μA), ion gun setting (Emission: 7.00 mA), photoelectron take-off angle (45°), Time per step (50 ms), Sweep (10 times), Pass energy (280 eV), and scanning range (15.5 to 1100 eV). The spectrum is measured in a form containing carbon atoms, phosphorus atoms, and the like detected from the layer of organic compound, and atoms detected from the base material, for example in the case of a chromium-plated base material, chromium atoms and oxygen atoms. The concentration of the detected atoms can be calculated from the obtained spectrum by using, for example, data analysis software PHI MultiPak (manufactured by ULVAC-PHI, Inc.). The obtained spectrum is subjected to charge correction with the C1s peak set to 284.5 eV. Then, the Shirley method is carried out on the measured peaks based on the electron orbits of the atoms to remove the background, and thereafter the peak area intensity is calculated. Analysis processing is performed that divides by the relative sensitive factors (RSF) for XPS preset in the data analysis software. In this way, the phosphorus atom concentration (hereinafter $C_P$) can be calculated. Further, in the same manner, the carbon atom concentration (hereinafter, $C_C$), the oxygen atom concentration (hereinafter, $C_O$), and the metal atom concentration (hereinafter, $C_M$) can be obtained. For the concentration calculation, the peak areas used are P2p peak for phosphorus, C1s peak for carbon, O1s peak for oxygen, and Cr2p3 peak for chromium.

The detection limit by XPS is the atomic concentration when the ratio (S/N) of the signal intensity (S) of the peak of the atomic concentration as the measurement target and the signal intensity (N) of the width of the background noise calculated in the range corresponding to 20 times the half width at the midpoint of the peak top is 3.

In the present invention, when the surface is analyzed, a portion having a relatively large radius of curvature is selected from the faucet fitting and cut into an analyzable size as a measurement sample. At the time of cutting, the portion to be analyzed evaluated is covered with a film or the like to prevent surface damage. The surface of the faucet fitting is washed before the measurement to sufficiently remove the stains adhering to the surface. For example, wipe washing with ethanol and sponge slide washing with a neutral detergent are followed by thorough rinse washing with ultrapure water. In the present invention, the elements detected by XPS analysis are carbon, oxygen, phosphorus, and atoms derived from the base material. The atoms derived from a base material differ depending on the base material, and may contain nitrogen and the like in addition to metal atoms. In the case of a chrome-plated faucet fitting, carbon, oxygen, phosphorus, and chromium are detected. When any other element is detected, it is considered to be a pollutant adhering to the surface of the faucet fitting. When a high concentration of pollutant-derived atoms is detected (when the concentration of pollutant-derived atoms exceeds 3 at %), it is regarded as an abnormal value. If an abnormal value is obtained, the atomic concentration is calculated by excluding the abnormal value. If there are many abnormal values, the surface of the faucet fitting is cleaned again, and the measurement is redone. In addition, when the faucet fitting is a rough-surfaced faucet fitting whose surface has been subjected to hairline processing, a portion with as high surface smoothness as possible is selected and measured.

In the faucet fitting of the present invention, the carbon atom concentration on the surface of the portion where the layer of organic compound is provided on the plating layer is preferably 35 at % or more, more preferably 40 at % or more, further preferably 43 at % or more, and most preferably 45 at % or more. In addition, the carbon atom concentration is preferably less than 70 at %, more preferably 65 at % or less, and further preferably 60 at % or less. The preferable range of the carbon atom concentration can be appropriately combined with these upper limit values and lower limit values. By setting the carbon atom concentration in such a range, it is possible to improve the scale removal performance.

The carbon atom concentration (hereinafter referred to as $C_C$) on the surface of the faucet fitting of the present invention can be determined by X-ray photoelectron spectroscopy (XPS) in the same manner as the measurement of the phosphorus atom concentration. Wide scan analysis is performed using the above-mentioned condition 1 as the measurement condition.

In the water faucet fitting of the present invention, the oxygen atom/metal atom concentration ratio (O/M ratio) on the surface of the portion where the layer of organic compound is provided on the plating layer is preferably 1.4 or more, more preferably 1.7 or more, further preferably 1.8 or more, and further preferably 2.0 or more. By setting the O/M ratio in such a range, the water resistance can be further improved.

The O/M ratio ($R_{O/M}$) can be calculated by the formula (A) using the above $C_O$ and $C_M$ obtained by XPS analysis.

$$R_{O/M}=C_O/C_M \quad \text{formula (A)}$$

Note that in the case of calculating Rum when R contains an ether group or a carbonyl group, it can be calculated based on the formula (B), keeping in mind that $C_O$ is the sum of the oxygen atom concentration $C_O$ derived from R—X and the oxygen atom concentration derived from the metal base material.

How to find $C_{O'}$: from the molecular structure specified by TOF-SIMS or HR-MS, the ratio of oxygen atoms to carbon atoms contained in R is used to make a relative comparison with $C_C$, and the oxygen atom concentration $C_{O'}$ contained in R is estimated.

$$R_{O/M}=(C_O-C_{O'})/C_M \quad \text{formula (B)}$$

In the faucet fitting of the present invention, the oxidized state of the metal element in the passivation layer can be confirmed by XPS. Narrow scan analysis is performed using condition 2 as the measurement condition.

(Condition 2)

X-ray condition: monochromatic AlKα ray (output 25 W)

Photoelectron take-off angle: 45°

Analysis area: 100 μmφ

Scanning range: different for each element (see next paragraph)

As the XPS device, PHI Quantera II (manufactured by ULVAC-PHI, Inc.) can be used. The spectrum of each metal element peak is obtained by narrow scan analysis under the conditions of X-ray condition (monochromatic AlKα ray, 25 W, 15 kv), analysis area: 100 μmφ, charge neutralizer setting (Emission: 20 μA), ion gun setting (Emission: 7.00 mA), photoelectron take-off angle (45°), Time per step (50 ms), Sweep (10 times), and Pass energy (112 eV). For example, when the metal element contained in the passivation layer is Cr, the spectrum of the Cr2p3 peak can be obtained by narrow scan analysis in the range of 570 to 590 eV. Chromium (Cr) in the oxidized state can be confirmed by the presence of a peak near 577 eV.

In the faucet fitting of the present invention, a water droplet contact angle on the surface of the portion where the layer of organic compound is provided on the plating layer is preferably 90° or more, and more preferably 100° or more. The water droplet contact angle means a static contact angle, and is obtained by dropping 2 μl of water droplet on the base material and photographing the water droplet after 1 second from the side surface of the base material. As the measuring device, for example, a contact angle meter (model number: SDMs-401, manufactured by Kyowa Interface Science Co., Ltd.) can be used.

A faucet fitting with a densely formed layer of organic compound, that is, a faucet fitting having a phosphorus atom concentration of 1.0 at % or more on the surface thereof, or a faucet fitting in which the layer of organic compound is SAM has excellent durability of the layer of organic compound even when exposed to warm water, and thus can be suitably used as a faucet for discharging hot water.

Specific examples of the method of producing the faucet fitting of the present invention are presented below.

The method of producing the faucet fitting of the present invention may be a method in which a layer of organic compound is formed only on the plating layer, or may be a method in which a layer of organic compound is formed on both the plating layer and the metal base material, and then the layer of organic compound on the metal base material is removed so that the phosphorus atom concentration of the metal base material is lower than the phosphorus atom concentration of the plating layer.

In the present invention, as a method of forming a layer of organic compound only on the plating layer, the surface of the plating layer is washed, and then a solution containing a compound represented by the general formula R—X is brought into contact with the surface of the plating layer to form the layer of organic compound. It is preferable that the surface of the plating layer is subjected to a passivation treatment in advance to sufficiently form a passivation layer. As the passivation treatment, in addition to the known methods, ultraviolet irradiation, ozone exposure, wet treatment, and combinations thereof can be preferably used. Examples of the method of bringing the solution into contact with the surface of the plating layer include a coating method by spraying or wiping, and a mist method in which the surface of the plating layer is brought into contact with the mist of the solution. An immersion method in which the faucet fitting is immersed in the solution may be used, but it is preferable to immerse the faucet fitting in the solution after performing a treatment in advance so that the solution does not come into contact with the metal base material. The treatment of preventing the solution from coming into contact with the metal base material includes masking of the surface of the metal base material, a cap at the entrance of a cavity such as a water passage or a threaded portion, and the like. The temperature and immersion time when the surface of the plating layer is immersed in a solution vary depending on the surface of the plating layer and the type of organic phosphonic acid compound, but are generally 0° C. or higher and 60° C. or lower, and 1 minute or longer and 48 hours or shorter. In order to form a dense layer of organic compound, it is preferable to lengthen the immersion time. It is preferable to form the layer of organic compound on the surface of the plating layer and then heat the faucet fitting. Specifically, it is heated so that the base material temperature is 40° C. or higher and 250° C. or lower, and preferably 60° C. or higher and 200° C. or lower. As a result, the bond between the layer of organic compound and the plating layer is promoted, making it possible to increase the number of M-O—P bonds per phosphonic acid group. Thus, the layer of organic compound improves in water resistance and wear resistance.

In the present invention, as the method in which a layer of organic compound is formed on both the plating layer and the metal base material, and then the layer of organic compound on the metal base material is removed so that the phosphorus atom concentration of the metal base material is lower than the phosphorus atom concentration of the plating layer, for example, it is preferable to perform a treatment of forming a layer of organic compound on both the plating layer and the metal base material by the immersion method and then removing the layer of organic compound on the metal base material. Examples of the treatment of removing the layer of organic compound of the metal base material include a method of bringing the metal base material portion into contact with a removal solution to perform ultrasonic cleaning. The removal solution may be an aqueous solution or an organic solvent. As an additive of the removal solution, a surfactant or the like can also be added. The conditions for contact with the removal solution are not particularly limited, but the removal rate can be increased by setting the temperature of the removal solution to 30° C. or higher.

EXAMPLES

The present invention is described in more detail with reference to the following Examples. The present invention is not limited to these Examples.

1. Sample Preparation 1-1. Base Material

For samples 1 to 9, a plate was used having a plating layer formed by nickel chrome plating on the surface of a base material made of brass. In addition, for samples 10 to 12, a brass plate (manufactured by YAMAMOTO-MS Co., Ltd.) for the hull cell (R) test device was used. In order to remove the stains on the surface of the base material and the surface of the plating layer, the base material was ultrasonically washed with an aqueous solution containing a neutral detergent, and was thoroughly washed away with running water after washing. In addition, in order to remove the neutral detergent of the base material, ultrasonic cleaning was performed with ion-exchanged water, and then water was removed with an air duster.

1-2. Pretreatment (Here, a Plate Having a Plating Layer Formed on the Surface of the Base Material is Also Referred to as a "Base Material" for Convenience)

(Samples 1, 5, 9, and 10)

The base material was introduced into a UV/Ozone Surface Processor (PL21-200 (S), manufactured by Sen Engineering Co., Ltd.), and UV ozone treatment was performed for a predetermined time.

(Sample 2)

The base material was introduced into a plasma CVD device (PBII-C600, manufactured by Kurita Manufacturing Co., Ltd.) and subjected to argon sputtering treatment for a predetermined time under the condition of a vacuum degree of about 1 Pa. Subsequently, oxygen was introduced into the device to perform oxygen plasma treatment.

(Sample 3)

The base material was immersed in an aqueous sodium hydroxide solution for a predetermined time, and then rinsed thoroughly with ion-exchanged water.

(Sample 4)

The base material was immersed in dilute sulfuric acid for a predetermined time, and then rinsed thoroughly with ion-exchanged water.

(Sample 6)

The base material was scrubbed with an abrasive made up of cerium oxide, and rinsed thoroughly with ion-exchanged water.

(Sample 7)

The base material was scrubbed with a weak alkaline abrasive (product name: Kiraria (registered trademark), manufactured by TOTO), and rinsed thoroughly with ion-exchanged water.

(Samples 8, 11 and 12)

The base material was not subjected to pretreatment.

1-3. Formation of the Layer of Organic Compound (Samples 1 to 8, 10, and 11)

As a treatment agent for forming a layer of organic compound, a solution of octadecylphosphonic acid (manufactured by Tokyo Chemical Industry Co., Ltd., product code 00371) dissolved in ethanol (manufactured by FUJIFILM Wako Pure Chemical Corporation, Wako 1st Grade) was used. The base material was immersed in the treatment agent for a predetermined time, and washed with ethanol. The immersion time was 1 minute or longer for samples 1 to 8 and 10, and 10 seconds or shorter for sample 11. Then, it was dried in a drier at 120° C. for 10 minutes to form a layer of organic compound on the surface of the base material.

(Sample 9)

As a treatment agent for forming a layer of organic compound of hydrocarbon groups containing fluorine atoms, a solution of (1H,1H,2H,2H-heptadecafluorodecyl) phosphonic acid (manufactured by Tokyo Chemical Industry Co., Ltd., product code H1459) dissolved in ethanol was used. The immersion time was 1 minute or longer. Then, it was dried at 120° C. for 10 minutes in a dryer to form a layer of organic compound of hydrocarbon groups containing fluorine atoms on the surface of the base material.

(Sample 12)

A layer of organic compound was not formed.

2. Analysis and Evaluation Methods

The following analysis and evaluation were carried out for each of the samples prepared above.

2-1. Measurement of Water Droplet Contact Angle

Before the measurement, each sample was scrubbed with a urethane sponge using a neutral detergent, and rinsed thoroughly with ultrapure water. A contact angle meter (model number: SDMs-401, manufactured by Kyowa Interface Science Co., Ltd.) was used for measuring the water droplet contact angle of each of the samples of samples 1 to 12. Ultrapure water was used as the water for measurement, and the size of water droplet to be dropped was 2 μl. The contact angle was a so-called static contact angle, which was set to the value one second after the water was dropped, and the average value measured at five different sites was obtained. However, when an abnormal value appeared for any of the five sites, the average value was calculated by excluding the abnormal value. Table 1 presents the measurement results as the water contact angle: initial.

2-2. Removability of Scale Stains

On the surface of each of the samples of samples 1 to 12, 20 μl of tap water was dropped and left for 24 hours to form scales on the sample surface. The sample having scales formed thereon was evaluated by the following procedure.

(i) a dry cloth was used to allow the sample to slide back and forth 10 times while applying a light load (50 gf/cm$^2$) to the surface of the sample.

(ii) a dry cloth was used to allow the sample to slide back and forth 10 times while applying a heavy load (100 gf/cm$^2$) to the surface of the sample.

Table 1 summarizes those that could be removed in the step (i) as "⊙", those that could be removed in the step (ii) as "○", and those that could not be removed as "x."

Note that whether or not scales could be removed was visually determined whether or not the scales remained on the surface of the sample after the surface of the sample was washed with running water, and the water was removed with an air duster.

Table 1 presents the evaluation results as the scale removability: initial.

2-3. Water Resistance Test

The surface of each of the samples of samples 1 to 9 was immersed in warm water at 70° C. for a predetermined time, and then the surface of the sample was washed with running water, and the water was removed with an air duster. The removability of scale stains was evaluated for each sample after the water resistance test. Those that could be removed by the method (ii) of 2-2 after the immersion time of 2 hours were marked with "○," and those that could not be removed were marked with "x." Furthermore, those that could be removed by the method (ii) of 2-2 after the immersion time of 120 hours were marked with "⊙." Table 1 presents the evaluation results after the scale removability and water resistance tests.

2-4. Measurement of Each Atomic Concentration

Each atomic concentration on the surface of samples 1 to 12 was determined by X-ray photoelectron spectroscopy (XPS). Before the measurement, it was scrubbed with a urethane sponge using a neutral detergent, and then rinsed thoroughly with ultrapure water. As the XPS device, PHI Quantera II (manufactured by ULVAC-PHI, Inc.) was used. The spectrum was obtained by wide scan analysis under the conditions of X-ray condition (monochromatic AlKα ray, 25 W, 15 kv), analysis area: 100 μmφ, charge neutralizer setting (Emission: 20 μA), ion gun setting (Emission: 7.00 mA), photoelectron take-off angle (45°), Time per step (50 ms), Sweep (10 times), Pass energy (280 eV), and scanning range (15.5 to 1100 eV). The concentration of the detected atoms was calculated from the obtained spectrum by using data analysis software PHI MultiPak (manufactured by ULVAC-PHI, Inc.). The obtained spectrum was subjected to charge correction with the C1s peak set to 284.5 eV. Then, the Shirley method was carried out on the measured peaks based on the electron orbits of the atoms to remove the background, and thereafter the peak area intensity was calculated. Analysis processing was performed that divides by the relative sensitive factors (RSF) for XPS preset in the data analysis software. In this way, the phosphorus atom concentration (hereinafter $C_P$), the oxygen atom concentration (hereinafter $C_O$), the metal atom concentration (hereinafter $C_M$), and the carbon atom concentration (hereinafter $C_C$) were calculated. For the concentration calculation, the peak areas used were P2p peak for phosphorus, C1s peak for carbon, O1s peak for oxygen, and Cr2p3 peak for chromium. The value of each concentration was the average value measured at three different sites. However, when an abnormal value appeared for any of the three sites, the average value was calculated by excluding the abnormal value. Table 1 presents the concentrations of the obtained phosphorus atom, oxygen atom, metal atom, and carbon atom.

2-5. Calculation of Rom

The $C_O$ and $C_M$ obtained by XPS analysis were used to calculate Rom by the formula (A). Table 1 presents the values of Rom obtained.

$$R_{O/M}=C_O/C_M \quad \text{formula (A)}$$

2-6. C1s Spectrum

Figure 5:
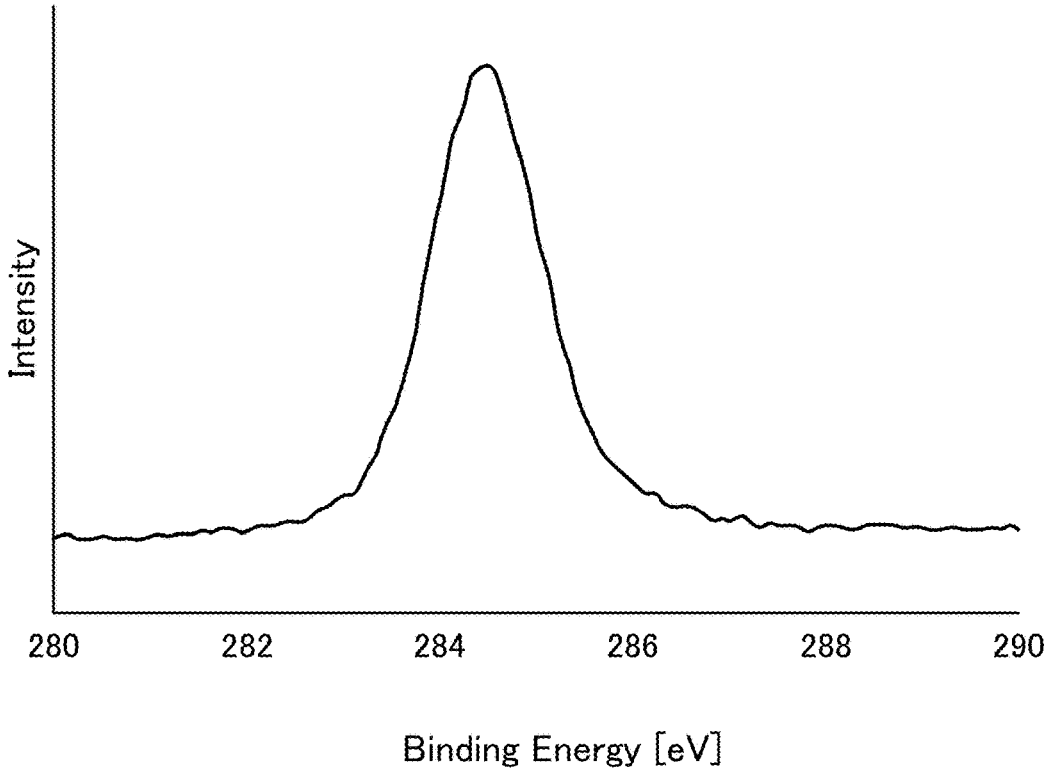
FIG. 5 illustrates a C1s spectrum obtained by XPS analysis of sample 3.

Before the measurement, the sponge was allowed to slide and washed with a neutral detergent, and then rinsed thoroughly with ultrapure water. As the XPS device, PHI Quantera II (manufactured by ULVAC-PHI, Inc.) was used. The C1s spectrum was obtained by measurement under the conditions of X-ray condition (monochromatic AlKα ray, 25 W, 15 kv), analysis area: 100 μmφ, charge neutralizer setting (Emission: 20 μA), ion gun setting (Emission: 7.00 mA), photoelectron take-off angle (45°), Time per step (50 ms), Sweep (10 times), Pass energy (112 eV), and scanning range (278 to 298 eV). FIG. 5 illustrates the C1s spectrum of sample 3.

2-7. P2p Spectrum

Figure 6:
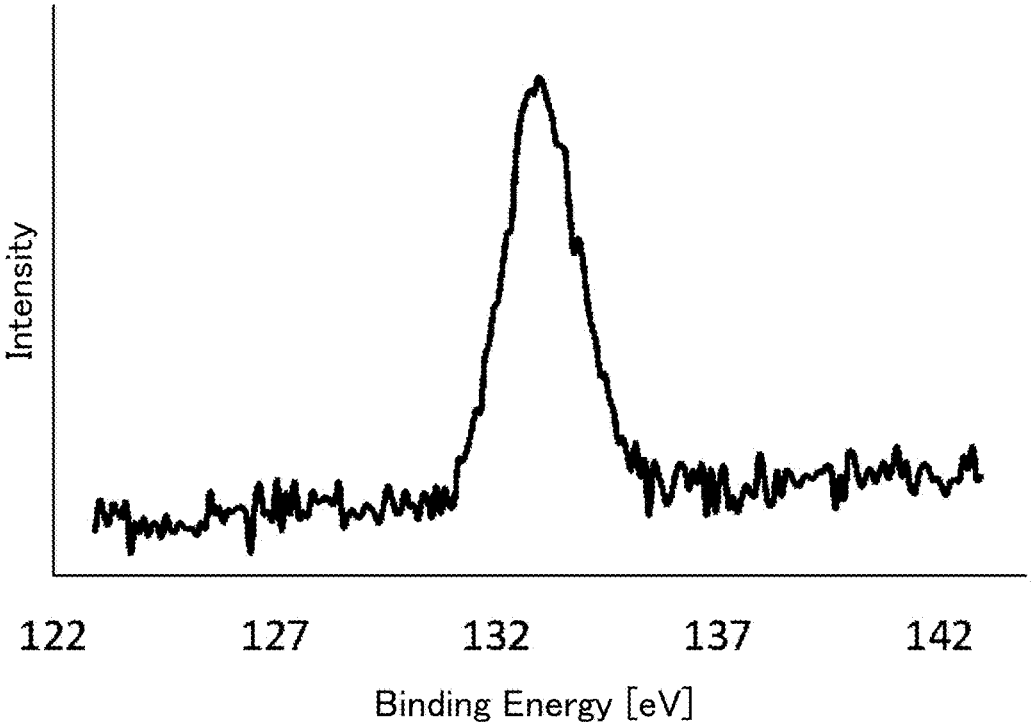
FIG. 6 illustrates a P2p spectrum obtained by XPS analysis of sample 3.

Before the measurement, the sponge was allowed to slide and washed with a neutral detergent, and then rinsed thoroughly with ultrapure water. As the XPS device, PHI Quantera II (manufactured by ULVAC-PHI, Inc.) was used. The P2p spectrum was obtained by measurement under the conditions of X-ray condition (monochromatic AlKα ray, 25 W, 15 kv), analysis area: 100 μmφ, charge neutralizer setting (Emission: 20 μA), ion gun setting (Emission: 7.00 mA), photoelectron take-off angle (45°), Time per step (50 ms), Sweep (10 times), Pass energy (112 eV), and scanning range (122 to 142 eV). FIG. 6 illustrates the P2p spectrum of sample 3.

2-8. Confirmation of Metal Elements in Oxide Layer

For samples 1 to 9, it was confirmed by X-ray photoelectron spectroscopy (XPS) that the metal element was in an oxide state. Before the measurement, the sponge was allowed to slide and washed with a neutral detergent, and then rinsed thoroughly with ultrapure water. As the XPS device, PHI Quantera II (manufactured by ULVAC-PHI, Inc.) can be used. The spectrum of each metal element peak was obtained by narrow scan analysis under the conditions of X-ray condition (monochromatic AlKα ray, 25 W, kv), analysis area: 100 μmφ, charge neutralizer setting (Emission: 20 μA), ion gun setting (Emission: 7.00 mA), photoelectron take-off angle (45°), Time per step (50 ms), Sweep (10 times), and Pass energy (112 eV). The range of narrow scan analysis was the range of Cr2p3 peak. It was confirmed that the background of the obtained peaks was removed by the Shirley method, and all the samples contained metal elements in an oxidized state.

2-9. Evaluation 1 of Thickness of Layer of Organic Compound

Figure 7:
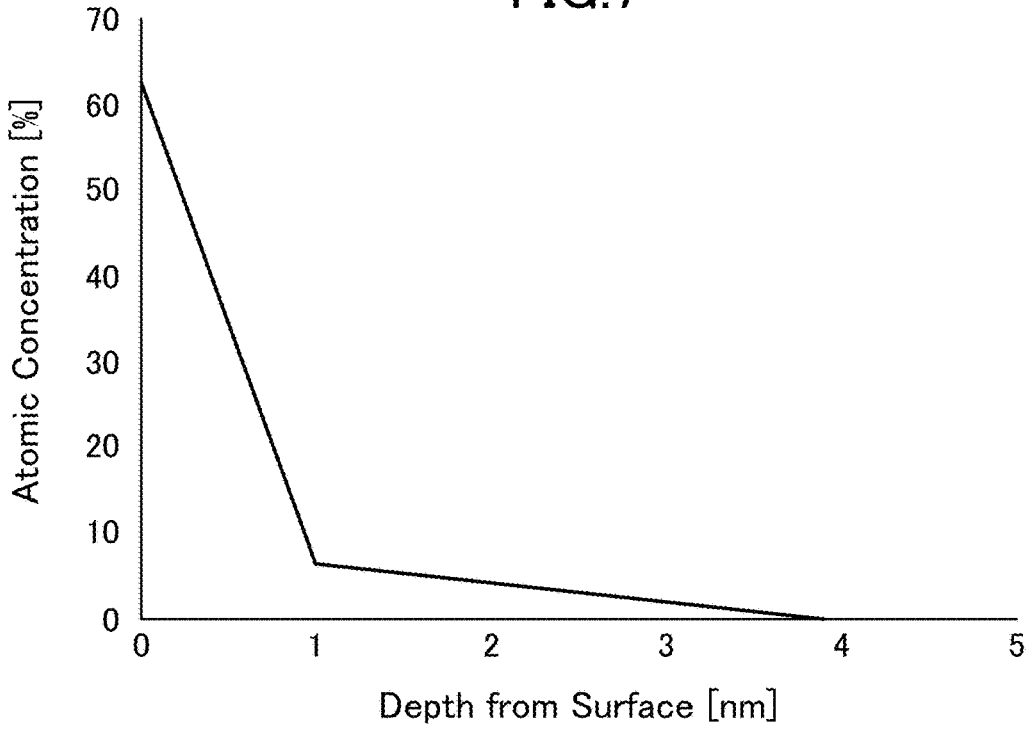
FIG. 7 illustrates the depth profile of the carbon atom concentration obtained by XPS analysis of sample 3 using argon ion beam sputtering.

The thickness of the layer of organic compound was evaluated by XPS depth profile measurement. The XPS measurement was performed under the same conditions as 2-4. The argon ion beam sputtering conditions were such that the sputtering rate was 1 nm/min. This sputtering rate was used to convert the sputtering time into the distance from the sample surface in the Z direction. The measurement point with a sputtering time of 0 minutes was set to the surface (0 nm), and the measurement was performed until the depth was 20 nm from the surface. The carbon atom concentration in the base material was defined as the carbon concentration at a depth of about 20 nm from the surface. The carbon atom concentration was measured in the depth direction from the sample surface, and the maximum depth at which the carbon atom concentration was higher by 1 at % or more than the carbon atom concentration of the base material was evaluated as the thickness of the layer of organic compound. For all the samples, the thickness of the layer of organic compound was 5 nm or less. As a measurement example, FIG. 7 illustrates an XPS depth profile of sample 3.

2-10. Evaluation 2 of Thickness of Layer of Organic Compound

The thickness of the layer of organic compound was evaluated by XPS depth profile measurement using an argon gas cluster ion beam (Ar-GCIB). The XPS measurement was performed under the same conditions as 2-9. The argon sputtering conditions were such that ion source: Ar2500+, acceleration voltage: 2.5 kV, sample voltage: 100 nA, sputtering area: 2 mm×2 mm, charge neutralization condition 1.1 V, and ion gun: 7 V. The sputtering rate used was a value (0.032 nm/min) obtained by performing Ar-GCIB measurement on octadecyltrimethoxysilane (1.6 nm) formed on a silicon wafer whose film thickness had been measured in advance by X-ray reflectometry (XRR) as a standard sample.

The film thickness of the standard sample is measured by X-ray reflectometry (XRR) (X'pert pro manufactured by PANalytical Ltd.) to obtain a (X-ray) reflectivity profile. For the obtained (X-ray) reflectivity profile, analysis software (X'pert Reflectivity) was used to perform fitting to the multilayer film model of Parratt and the roughness formula of Nevot-Crosse, to thereby obtain the film thickness of the standard sample. Next, Ar-GCIB measurement was performed on the standard sample to obtain the sputtering rate (0.029 nm/min) of the layer of organic compound. For the film thickness of the layer of organic compound on the sample (layer of organic compound), the obtained sputtering rate was used to convert the sputtering time into the distance from the sample surface in the Z direction. The XRR measurement and analysis conditions and the Ar-GCIB measurement conditions are as follows.

(XRR Measurement Conditions)

Device: X'pert pro (PANalytical Ltd.)
X-ray source: CuKα
Tube voltage: 45 kV
Tube current: 40 mA
Incident Beam Optics
Divergence slit: ¼°
Mask: 10 mm
Solar slit: 0.04 rad
Anti-scattering slit: 1°
Diffracted Beam Optics
Anti-scattering slit: 5.5 mm
Solar slit: 0.04 rad
X-ray detector: X'Celerator
Pre Fix Module: Parallel plate Collimator 0.27
Incident Beam Optics: Beam Attenuator Type Non
Scan mode: Omega
Incident angle: 0.105-2.935

(XRR Analysis Conditions)

The following initial conditions are set.
Layer sub: Diamond Si (2.4623 g/cm$^3$)
Layer 1: Density Only SiO2 (2.7633 g/cm$^3$)
Layer 2 Density Only C (1.6941 g/cm$^3$)

(Ar-GCIB Measurement Conditions)

Device: PHI Quantera II (manufactured by ULVAC-PHI, Inc.)
X-ray conditions: monochromatic AlKα ray, 25 W, 15 kv Analysis area: 100 mφ
Charge neutralizer setting: 20 μA
Ion gun setting: 7.00 mA
Photoelectron take-off angle: 45°
Time per step: 50 ms
Sweep: 10 times
Pass energy: 112 eV
Measurement interval: 10 min
Spatter-setting: 2.5 kV
Binding energy: C1s (278 to 298 eV)

Figure 8:
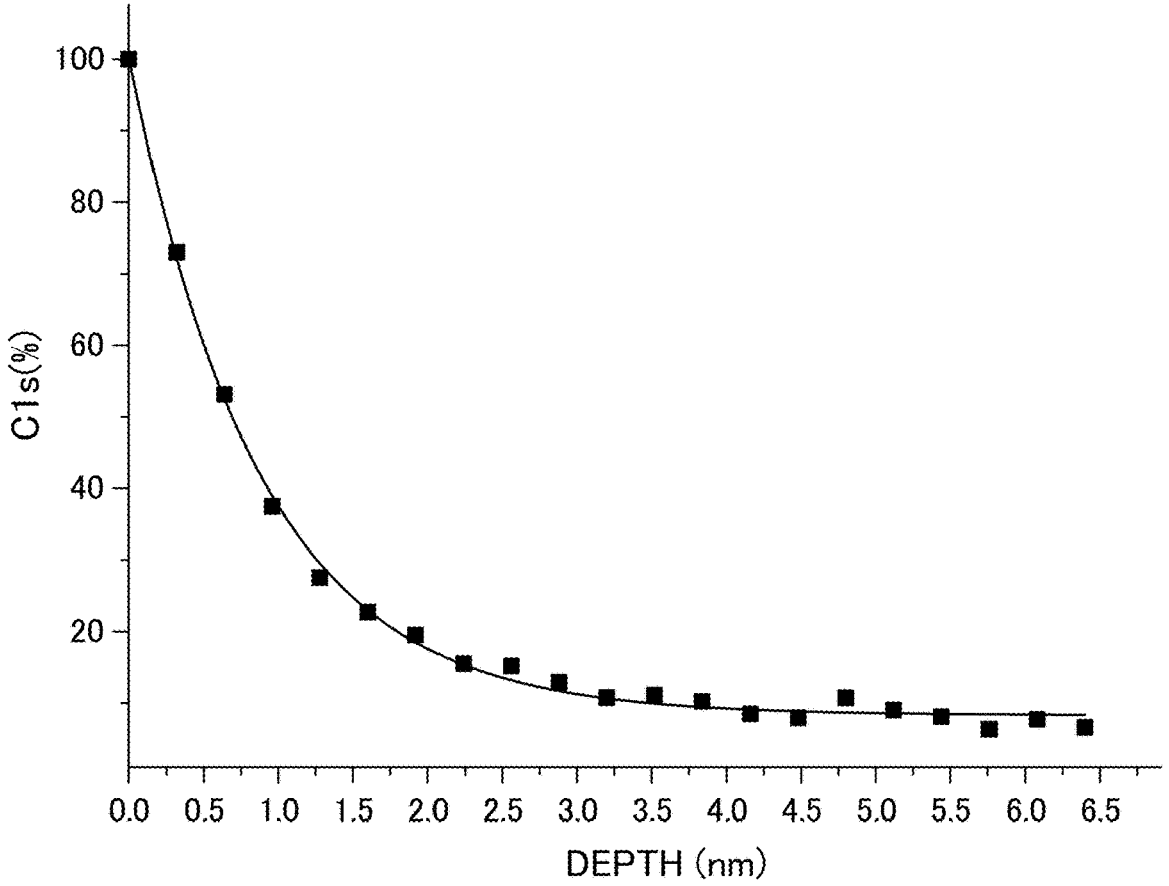
FIG. 8 illustrates the depth profile of the carbon atom concentration obtained by XPS analysis using an argon gas cluster ion beam (Ar-GCIB) of sample 3.
Figure 9A:
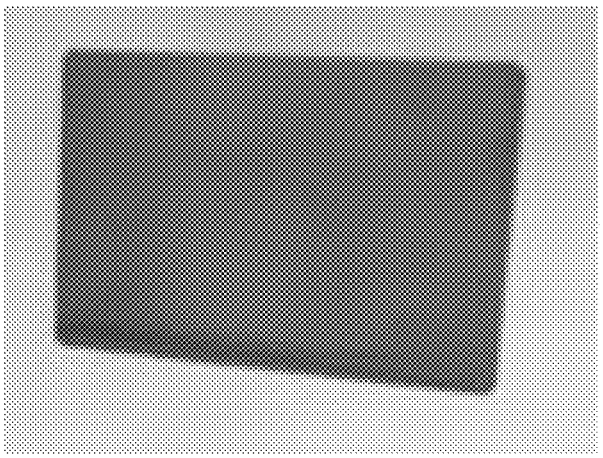
FIG. 9A is an appearance photograph of sample 12 after corrosiveness evaluation.
Figure 9B:
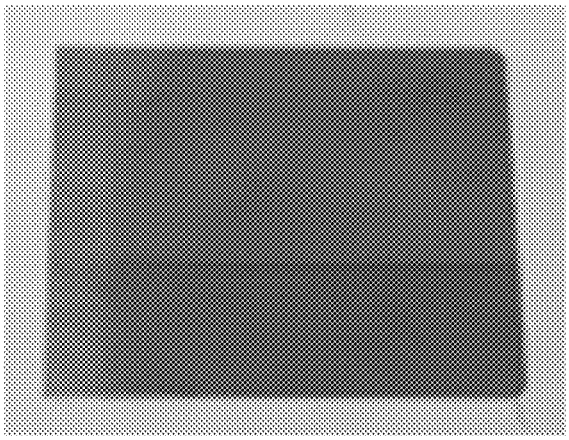
FIG. 9B is an appearance photograph of sample 11 after corrosiveness evaluation.
Figure 9C:
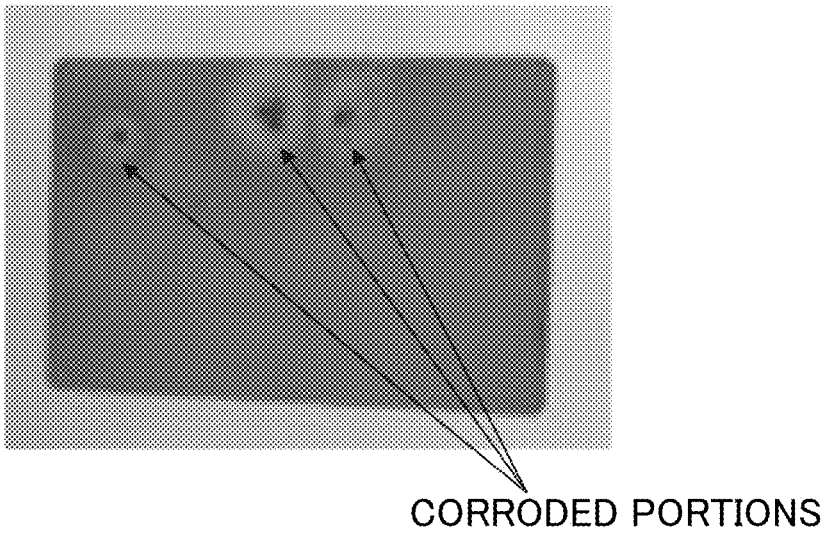
FIG. 9C is an appearance photograph of sample 10 after corrosiveness evaluation.
Figure 9D:
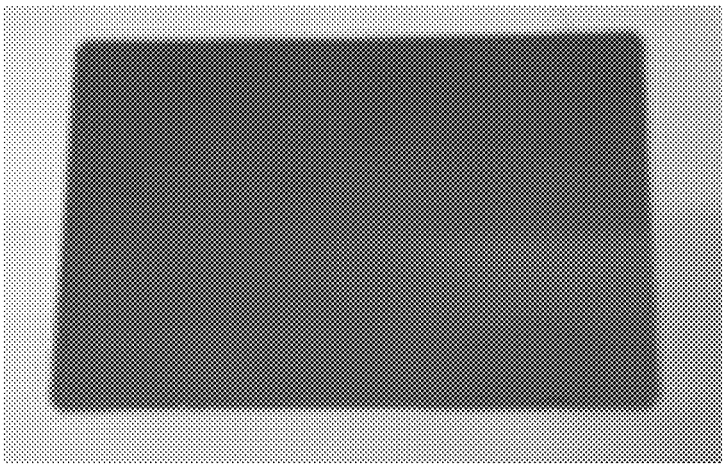
FIG. 9D is an appearance photograph of sample 3 after corrosiveness evaluation.

This sputtering rate was used to convert the sputtering time into the distance from the sample surface in the Z direction. The carbon atom concentration was measured in the depth direction from the surface of the sample by measuring up to a sputtering time of 100 minutes with the surface (0 nm) as the measurement point with a sputtering time of 0 minutes. A depth profile plotted for each depth was drawn with the horizontal axis representing the depth (nm) converted from the sputtering rate and the vertical axis representing the carbon (C1s) concentration on the surface as 100%, and the film thickness of the layer of organic compound was calculated from the horizontal axis of the inflection point of the depth profile curve. The film thickness was the average value measured at three different sites. However, when an abnormal value appeared for any of the three sites, the average value was calculated by excluding the abnormal value. Table 1 presents the results. As a measurement example, FIG. 8 illustrates an AR-GCIB depth profile of XPS of sample 3. The film thickness obtained from the inflection point of the depth profile was 2.0 nm.

TABLE 2

| | Metal Base Material | Plating Layer | P-Concentration (at %) | Corrosiveness Evaluation |
|---|---|---|---|---|
| Sample 12 | Brass | No | 0 | ◎ |
| Sample 11 | Brass | No | 0.9 | ○ |
| Sample 10 | Brass | No | 2.0 | X |
| Sample 3 | Brass | Yes | 2.3 | ◎ |

2-8. Corrosiveness Evaluation

Samples 3 and 10 to 12 were immersed in water (product name: CONTREX (registered trademark), manufactured by Nestlé) at room temperature for 60 hours. After that, each sample was visually observed, and those were evaluated as "⊙" for which local corrosion was not observed, those were evaluated as "○" for which it was not visually observed but was slightly observed with a microscope, and those were evaluated as "x" for which it was visually observed. Table 2 presents the obtained evaluation results, and FIG. 9 presents an appearance photograph after being immersed in water.

2-9. Formation of Layer of Organic Compound on Faucet Fitting

A faucet fitting (product number: TLG04305JA, manufactured by TOTO Ltd., samples 13 and 14) plated with nickel chrome on brass was used. Before the treatment, the faucet fitting was disassembled into a handle portion and a main body portion. Sample 13 was subjected to a treatment of protecting each of the main body portion and the handle portion with a tape so that the treatment agent would not come into contact with the portion where the plating layer

TABLE 1

| | Metal Base Material | Plating Layer | Pretreatment | Layer of Organic Compound | Thickness of Layer of Organic Compound (nm) |
|---|---|---|---|---|---|
| Sample 1 | Brass | Yes | UV Ozone | Octadecylphosphonic Acid | — |
| Sample 2 | Brass | Yes | Ar, $O_2$ Plasma | Same as Above | — |
| Sample 3 | Brass | Yes | NaOHaq | Same as Above | 2.0 |
| Sample 4 | Brass | Yes | $H_2SO_4$aq | Same as Above | — |
| Sample 5 | Brass | Yes | UV Ozone | Same as Above | 1.1 |
| Sample 6 | Brass | Yes | Cerium Oxide Abrasive | Same as Above | — |
| Sample 7 | Brass | Yes | Weakly Alkaline Abrasive | Same as Above | — |
| Sample 8 | Brass | Yes | No | Same as Above | — |
| Sample 9 | Brass | Yes | UV Ozone | Heptadecafluorodecylphosphonic Acid | 1.1 |
| Sample 10 | Brass | No | UV Ozone | Octadecylphosphonic Acid | — |
| Sample 11 | Brass | No | No | Same as Above | — |
| Sample 12 | Brass | No | No | No | — |

| | XPS Surface Atomic Concentration (at %) | | | | | Scale Removability | | Water Contact |
|---|---|---|---|---|---|---|---|---|
| | Phosphorus ($C_P$) | Oxygen ($C_O$) | Metal ($C_M$) | Carbon ($C_C$) | $R_{O/M}$ | Initial | After Water Resistance Test | Angle Initial |
| Sample 1 | 2.0 at % | 29 at % | 8 at % | 61 at % | 3.5 | ◎ | ◎ | 107° |
| Sample 2 | 2.5 at % | 31 at % | 9 at % | 57 at % | 3.3 | ◎ | ◎ | 107° |
| Sample 3 | 2.3 at % | 24 at % | 9 at % | 64 at % | 2.8 | ◎ | ◎ | 108° |
| Sample 4 | 2.4 at % | 29 at % | 12 at % | 56 at % | 2.5 | ◎ | ◎ | 108° |
| Sample 5 | 1.5 at % | 35 at % | 14 at % | 49 at % | 2.5 | ◎ | ◎ | 106° |
| Sample 6 | 2.2 at % | 24 at % | 14 at % | 59 at % | 1.7 | ◎ | ○ | 108° |
| Sample 7 | 1.9 at % | 23 at % | 17 at % | 58 at % | 1.4 | ◎ | ○ | 108° |
| Sample 8 | 1.2 at % | 33 at % | 11 at % | 54 at % | 2.9 | ○ | ○ | 105° |
| Sample 9 | 1.3 at % | 30 at % | 12 at % | 56 at % | 2.5 | ○ | X | 115° |
| Sample 10 | 2.0 at % | 18 at % | 5 at % | 51 at % | 3.6 | X | — | 106° |
| Sample 11 | 0.9 at % | — | — | | — | X | — | 94° |
| Sample 12 | 0.0 at % | — | — | | — | X | — | |

was not formed. As the tape, a Kapton tape (manufactured by Nitto Denko Corporation) was used. Specifically, as the handle portion, the portion where the plating layer was not formed was directly covered with tape. As the main body portion, the three openings were closed with tape so that the treatment agent would not infiltrate into the inner portion where the plating layer was not formed, such as the water passage. In sample 14, the portion where the plating layer was not formed was not protected by tape.

2-9. Formation of Layer of Organic Compound on Faucet Fitting

Each portion of the sample was ultrasonically washed with an aqueous solution containing a neutral detergent in order to remove stains on the surface thereof, and after washing, it was thoroughly washed with running water. In addition, in order to remove the neutral detergent of each portion, ultrasonic cleaning was performed with ion-exchanged water, and then the water was removed with an air duster. Then, each portion was immersed in an aqueous sodium hydroxide solution for a predetermined time, and then rinsed thoroughly with ion-exchanged water. As a treatment agent for forming a layer of organic compound, a solution of octadecylphosphonic acid (manufactured by Tokyo Chemical Industry Co., Ltd., product code 00371) dissolved in ethanol (manufactured by FUJIFILM Wako Pure Chemical Corporation, Wako 1st Grade) was used. Each portion was immersed in a treatment agent for 1 minute or more to form a layer of organic compound, and then each portion was taken out, and ethanol was poured on the surface of each portion for cleaning to remove excess treatment liquid on the surface. Then, it was dried in a drier at 120° C. for 10 minutes, and the layer of organic compound was fixed on the surface of each portion. After the faucet fitting was left at room temperature for a while, the tape attached to each portion of sample 13 was peeled off to expose the portion where the plating layer was not formed. 2-10. Corrosiveness Evaluation of Faucet Fitting Samples 13 and 14 were immersed in water (product name: CONTREX (registered trademark), manufactured by Nestlé) at room temperature for 168 hours. Then, the portion where the plating layer was not formed was visually observed. No local corrosion was observed in sample 13. On the other hand, in sample 14, local corrosion was observed in the portion where the plating layer was not formed.

(Confirmation of R—X)

To confirm R—X, TOF-SIMS and ESI-TOF-MS/MS were used.

(Confirmation of R—X by TOF-SIMS)

The measurement conditions of TOF-SIMS were such that primary ions to be emitted: $^{209}Bi_3^{++}$, primary ion acceleration voltage 25 kV, pulse width 10.5 or 7.8 ns, bunching: on, electrification neutralization: off, post acceleration 9.5 kV, measurement range (area): about 500×500 $\mu m^2$, secondary ions to be detected: Positive, Negative, Cycle Time: 110 μs, scan count 16.

For samples 1 to 8 and 10 using octadecylphosphonic acid ($C_{18}H_{39}O_3P$) as the treatment agent, it was confirmed that peaks were detected at m/z=335 ($C_{18}H_{40}O_3P^+$) in the positive mode and at m/z=333 ($C_{18}H_{38}O_3P^-$) in the negative mode.

(ESI-TOF-MS/MS)

For ESI-TOF-MS/MS measurement, Triple TOF 4600 (manufactured by SCIEX) was used. In the measurement, the cutout base material was immersed in ethanol, and the treatment agents used for forming the layer of organic compound were extracted with unnecessary components filtered, transferred to a vial (about 1 mL), and then measured. MS/MS measurement was performed under the measurement conditions that ion source: ESI/Duo Spray Ion Source, ion mode (Positive/Negative), IS voltage (4500/−4500 V), source temperature (600° C.), DP (100 V), and CE (40 V/−40 V), for example.

Figure 10:
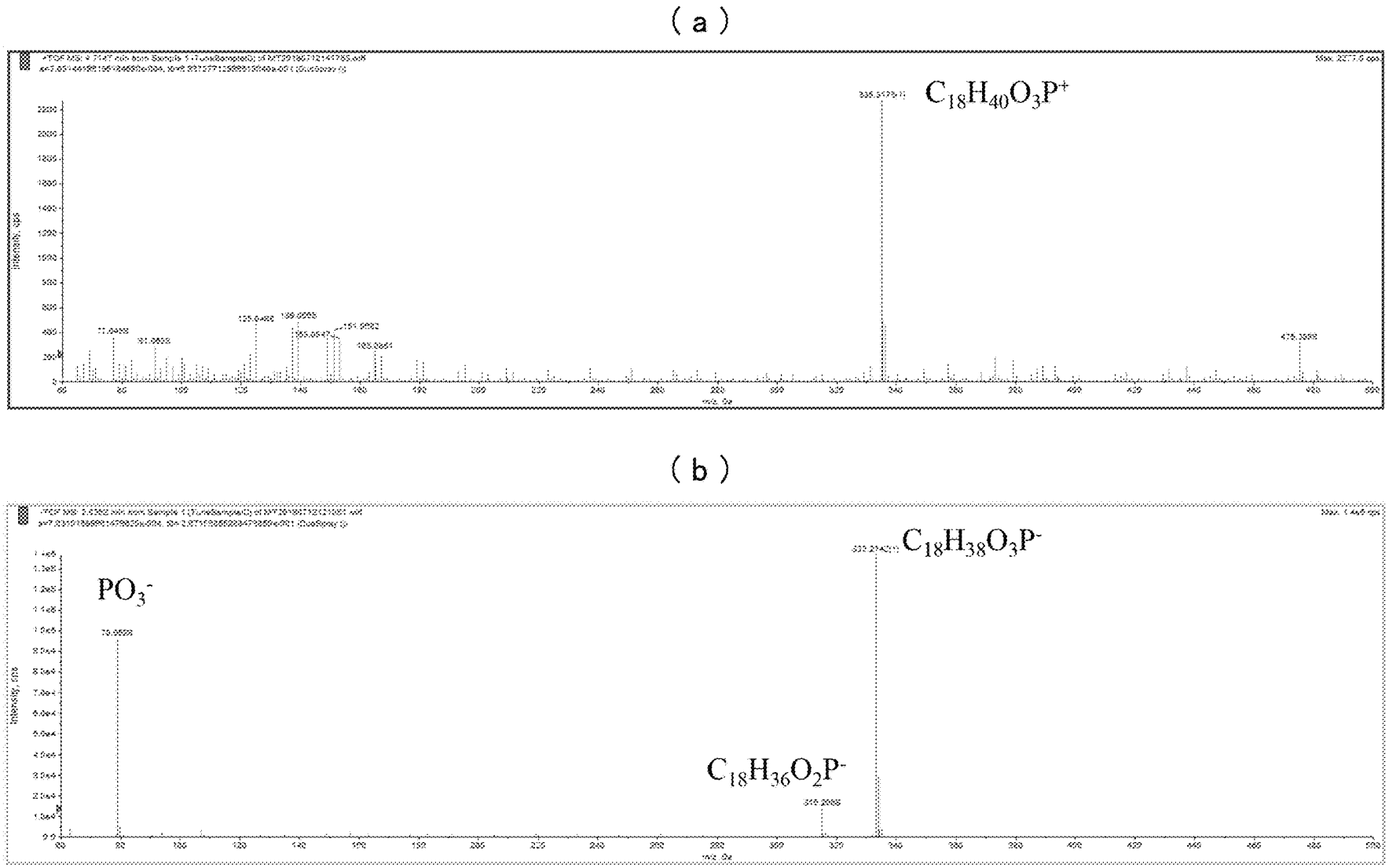
FIG. 10 illustrates mass spectra ((a) positive, (b) negative) obtained by Q-TOF-MS/MS analysis of sample 3.

For samples 1 to 8 and 10 using octadecylphosphonic acid ($C_{18}H_{39}O_3P$) as the treatment agent, it was confirmed that peaks were detected at m/z=335.317 ($C_{18}H_{40}O_3P^+$) in the positive mode of the MS/MS analysis, and at m/z=333.214 ($C_{18}H_{38}O_3P^-$) and m/z=78.952 (fragment ion $PO_3^-$ of $C_{18}H_{38}O_3P^-$) in the negative mode. FIG. 10 illustrates the spectrum obtained by Q-TOF-MS/MS analysis of sample 3.

(Confirmation that One End of R, which is an End that is not a Bonding End with X, is Made Up of C and H)

Surface enhanced Raman spectroscopy was used to confirm that one end of R was made up of C and H and that R was a hydrocarbon made up of C and H.

(Confirmation by Surface Enhanced Raman)

As the surface enhanced Raman spectroscopy analyzer, a transmission-type plasmonic sensor (for surface enhanced Raman spectroscopy) described in Japanese Patent No. 6179905 was used as the surface enhanced Raman sensor, and NanoFinder 30 (Tokyo Instruments, Inc.) was used as a confocal microscope Raman spectrometer. The measurement was performed with a transmission-type surface enhanced Raman sensor placed on the cutout surface of the base material. The measurement conditions were such that Nd: YAG laser (532 nm, 1.2 mW), scan time (10 seconds), grating (800 Grooves/mm), and pinhole size (100 μm).

For samples 1 to 8 and 10 using octadecylphosphonic acid ($C_{18}H_{39}O_3P$) as the treatment agent, the detection of Raman shift 2930 $cm^{-1}$ confirmed that one end of R was a methyl group.

In addition, the detection of Raman shift 2850 and 2920 $cm^{-1}$ confirmed that R was a hydrocarbon made up of C and H.

(Confirmation of M-O—P Bond)

To confirm the M-O—P bond, TOF-SIMS and surface enhanced Raman spectroscopy were used.

(Confirmation of M-O—P by TOF-SIMS)

Figure 11:
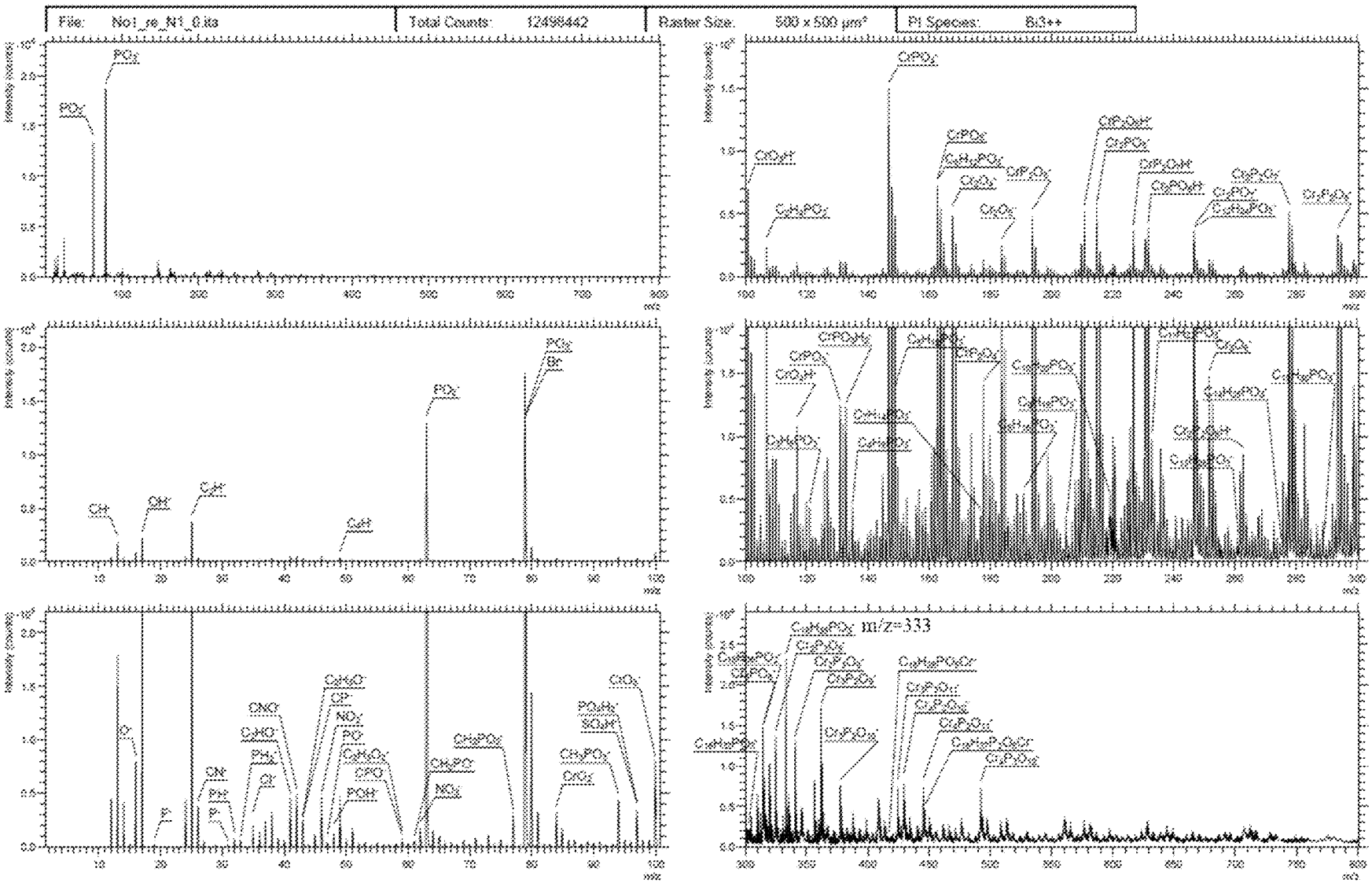
FIG. 11 illustrates a secondary ion mass spectrum (negative) obtained by TOF-SIMS analysis of sample 3.

The measurement conditions of TOF-SIMS were such that primary ions to be emitted: $^{209}Bi_3^{++}$, primary ion acceleration voltage 25 kV, pulse width 10.5 or 7.8 ns, bunching: on, electrification neutralization: off, post acceleration 9.5 kV, measurement range (area): about 500×500 $\mu m^2$, secondary ions to be detected: Positive, Negative, Cycle Time: 110 μs, scan count 16. As a measurement result, a secondary ion mass spectrum (m/z) derived from R—X is obtained. Confirmation was made by obtaining, as results of the measurement, a secondary ion mass spectrum derived from a combination of R—X and the metal oxide element M (R—X-M) and a secondary ion mass spectrum derived from M-O—P (m/z). FIG. 11 illustrates the secondary ion mass spectrum in the negative mode obtained by TOF-SIMS analysis of sample 3.

For samples 1 to 8 containing Cr in the passivation layer and using octadecylphosphonic acid ($C_{18}H_{39}O_3P$) as the treatment agent, it was confirmed that any of the ions with m/z=417 ($C_{18}H_{38}PO_5Cr^-$) and m/z=447 ($C_{18}H_{37}P_2O_5Cr^-$) (R—X-M) was detected as well as the ion with 146 ($PO_4Cr^-$) (O-M-O—P) in the negative mode.

(Confirmation of M-O—P by Surface Enhanced Raman)

As the surface enhanced Raman spectroscopy analyzer, a transmission-type plasmonic sensor (for surface enhanced Raman spectroscopy) described in Japanese Patent No. 6179905 was used as the surface enhanced Raman sensor, and NanoFinder 30 (Tokyo Instruments, Inc.) was used as a confocal microscope Raman spectrometer. The measurement was performed with a transmission-type surface enhanced Raman sensor placed on the cutout surface of the base material. The measurement conditions were such that Nd: YAG laser (532 nm, 1.2 mW), scan time (10 seconds), grating (800 Grooves/mm), and pinhole size (100 μm).

The signal derived from the M-O—P bond was assigned from the Raman signal in which the bond state of the M-O—P bond immobilized on the oxide layer had been estimated in advance using Material Studio as a first principle calculation software package. As the calculation conditions for the first principle calculation, structure optimization was performed with software used (CASTEP), functional (LDA/CA-PZ), cutoff (830 eV), K point (2*2*2), pseudopotential (Norm-conserving), Dedensity mixing (0.05), spin (ON), and Metal (OFF). In addition, Raman spectrum calculation was performed with software used (CASTEP), functional (LDA/CA-PZ), cutoff (830 eV), K point (1*1*1), pseudopotential (Norm-conserving), Dedensity mixing (All Bands/EDFT), spin (OFF), and Metal (OFF).

It was confirmed as follows that a signal derived from each bond state of M-O—P was detected for samples 1 to 8 containing chromium as the metal element of the base material.

By detecting two or more signals for the Raman shifts 377 $cm^{-1}$, 684 $cm^{-1}$, 772 $cm^{-1}$, and 1014 $cm^{-1}$, it was confirmed that the phosphonic acid obtained by first principle calculation contained a state bonded with one chromium atom (state with one M-O—P bond per phosphonic acid group: "bond 1").

By detecting two or more signals for the Raman shifts 372 $cm^{-1}$, 433 $cm^{-1}$, 567 $cm^{-1}$, 766 $cm^{-1}$, and 982 $cm^{-1}$, it was confirmed that the phosphonic acid obtained by first principle calculation contained a state bonded with two chromium atoms (state with two M-O—P bonds per phosphonic acid group: "bond 2").

By detecting two or more signals for the Raman shifts 438 $cm^{-1}$, 552 $cm^{-1}$, 932 $cm^{-1}$, and 1149 $cm^{-1}$, it was confirmed that the phosphonic acid obtained by first principle calculation contained a state bonded with three chromium atoms (state with three M-O—P bonds per phosphonic acid group: "bond 3").

Figure 12:
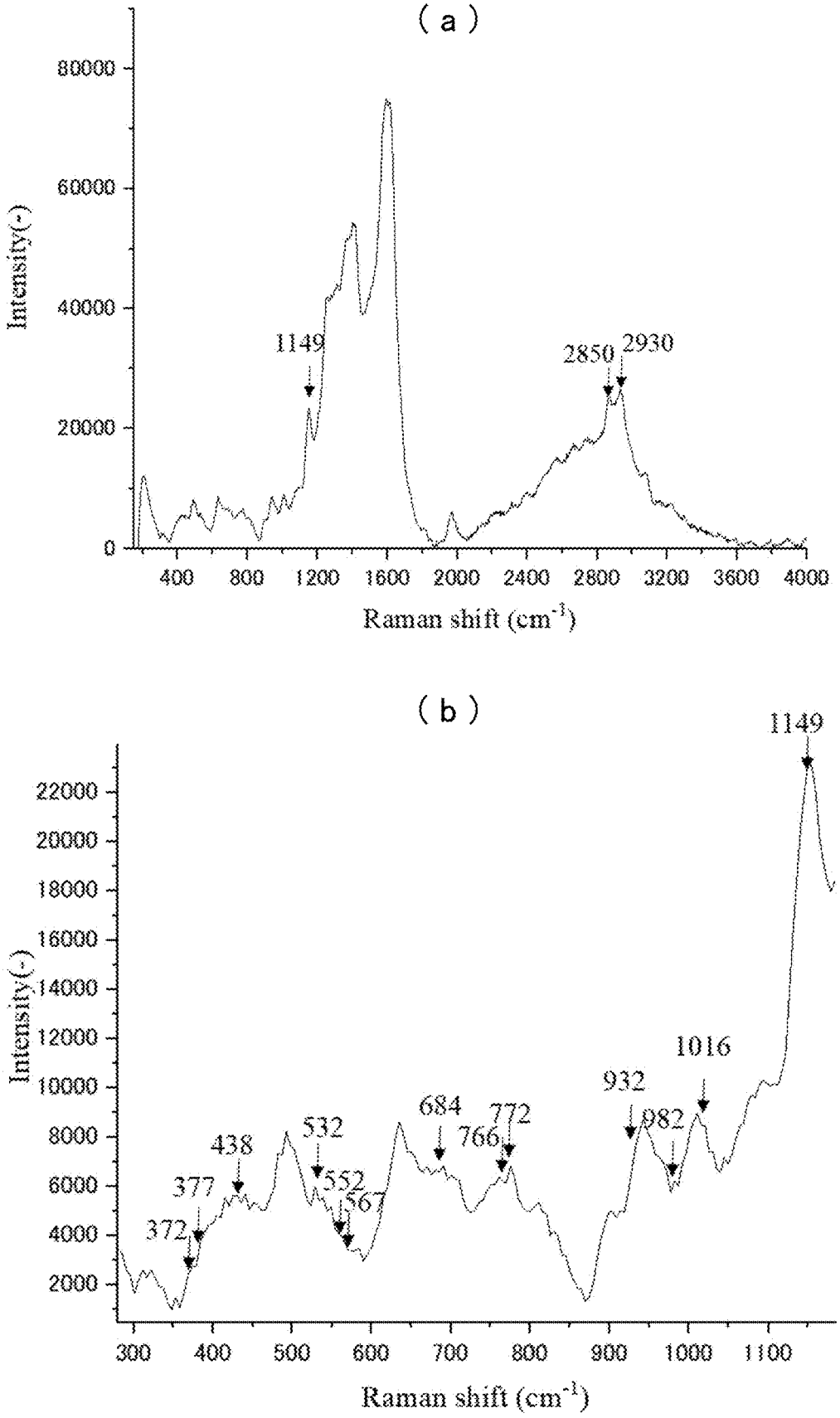
FIG. 12 illustrates Raman spectra ((a) 180 to 4000 $cm^{-1}$, (b) 280 to 1190 $cm^{-1}$) obtained by SERS Raman analysis of sample 3.

FIG. 12 illustrates a transmission-type surface enhanced Raman spectrum of sample 3. For sample 3, since signals were detected for the Raman shifts 377 $cm^{-1}$, 684 $cm^{-1}$, 772 $cm^{-1}$, 1014 $cm^{-1}$, 372 $cm^{-1}$, 433 $cm^{-1}$, 567 $cm^{-1}$, 766 $cm^{-1}$, 982 $cm^{-1}$, 438 $cm^{-1}$, 552 $cm^{-1}$, 932 $cm^{-1}$, 1149 $cm^{-1}$, it was confirmed that the phosphonic acid contained all the bonds of bond 1, bond 2, and bond 3 for the chromium atoms.

What is claimed is:

1. A faucet fitting comprising:

a metal base material; and a plating layer partially formed on a surface of the metal base material, wherein the metal base material contains at least one metal element selected from the group consisting of copper, zinc, and tin, the plating layer contains at least one metal element selected from the group consisting of chromium and nickel, a layer of organic compound is further provided on the plating layer via a passivation layer existing on the surface of the plating layer, the layer of organic compound binds to the passivation layer by binding the metal element (M) constituting the passivation layer via an oxygen atom (O) to a phosphorus atom (P) of at least one group (X) selected from a phosphonic acid group, a phosphoric acid group, and a phosphinic acid group (M-O—P bond), and the group X is bonded to a group R, where R is a hydrocarbon group or a group having an atom other than carbon at one or two positions in the hydrocarbon group, and a phosphorus atom concentration on a surface of a portion where the plating layer is not formed on the metal base material is lower than a phosphorus atom concentration on a surface of the layer of organic compound provided on the plating layer.

2. The faucet fitting according to claim 1, wherein the phosphorus atom concentration on the surface of the portion where the plating layer is not formed on the metal base material, which is calculated from a peak area of a P2p spectrum measured according to condition 1 by X-ray photoelectron spectroscopy (XPS), is less than a lower limit of detection, (Condition 1)

X-ray condition: monochromatic AlKα ray (output 25 W)

Photoelectron take-off angle: 45°

Analysis area: 100 μmφ

Scanning range: 15.5 to 1100 eV.

3. The faucet fitting according to claim 2, wherein the portion where the plating layer is not formed is a water passage or a threaded portion.

4. The faucet fitting according to claim 1, wherein the portion where the plating layer is not formed is a water passage or a threaded portion.

5. The faucet fitting according to claim 1, wherein the metal base material is made up of an alloy.

6. The faucet fitting according to claim 1, wherein in the layer of organic compound, one end of R, which is an end that is not a bonding end with X, is made up of C and H.

7. The faucet fitting according to claim 1, wherein in the layer of organic compound, X is made up of phosphonic acid.

8. The faucet fitting according to claim 1, wherein the layer of organic compound is free of a fluorine atom.

9. The faucet fitting according to claim 1, wherein the layer of organic compound is a self-assembled monolayer.

10. The faucet fitting according to claim 1, wherein a phosphorus atom concentration on a surface of a portion where the layer of organic compound is provided on the plating layer, which is calculated from the peak area of the P2p spectrum measured according to condition 1 by X-ray photoelectron spectroscopy (XPS), is more than 1.0 at % and 10 at % or less, (Condition 1)

X-ray condition: monochromatic AlKα ray (output 25 W)

Photoelectron take-off angle: 45°

Analysis area: 100 μmφ

Scanning range: 15.5 to 1100 eV.

11. The faucet fitting according to claim 10, wherein a carbon atom concentration on the surface of the portion where the layer of organic compound is provided on the plating layer, which is calculated from a peak area of a C1s spectrum measured according to condition 1 by X-ray photoelectron spectroscopy (XPS), is 35 at % or more, (Condition 1)

X-ray condition: monochromatic AlKα ray (output 25 W)

Photoelectron take-off angle: 45°

Analysis area: 100 μmφ

Scanning range: 15.5 to 1100 eV.

12. The faucet fitting according to claim 10, wherein an oxygen atom/metal atom concentration ratio (O/M ratio) on the surface of the portion where the layer of organic compound is provided on the plating layer, which is calculated from peak areas of an O1s spectrum and a metal spectrum measured according to condition 1 by X-ray photoelectron spectroscopy (XPS), is 1.4 or more, (Condition 1)

X-ray condition: monochromatic AlKα ray (output 25 W)

Photoelectron take-off angle: 45°

Analysis area: 100 μmφ

Scanning range: 15.5 to 1100 eV.

13. The faucet fitting according to claim 1, wherein a carbon atom concentration on the surface of the portion where the layer of organic compound is provided on the plating layer, which is calculated from a peak area of a C1s spectrum measured according to condition 1 by X-ray photoelectron spectroscopy (XPS), is 35 at % or more, (Condition 1)

X-ray condition: monochromatic AlKα ray (output 25 W)

Photoelectron take-off angle: 45°

Analysis area: 100 μmφ

Scanning range: 15.5 to 1100 eV.

14. The faucet fitting according to claim 1, wherein an oxygen atom/metal atom concentration ratio (O/M ratio) on the surface of the portion where the layer of organic compound is provided on the plating layer, which is calculated from peak areas of an O1s spectrum and a metal spectrum measured according to condition 1 by X-ray photoelectron spectroscopy (XPS), is 1.4 or more, (Condition 1)

X-ray condition: monochromatic AlKα ray (output 25 W)

Photoelectron take-off angle: 45°

Analysis area: 100 μmφ

Scanning range: 15.5 to 1100 eV.

* * * * *